United States Patent [19]

Terao

[11] 4,205,516

[45] Jun. 3, 1980

[54] ELECTRONIC DISPLAY DEVICE

[75] Inventor: Hiroyuki Terao, Kodaira, Japan

[73] Assignee: Casio Computer Co., Ltd., Tokyo, Japan

[21] Appl. No.: 893,511

[22] Filed: Apr. 4, 1978

[51] Int. Cl.[2] ..... G04B 19/24; G04B 19/30; G08B 23/00

[52] U.S. Cl. ..... 368/29; 340/756; 340/765; 364/705; 368/82; 368/31

[58] Field of Search ..... 58/4 A, 4 R, 23 R, 50 R, 58/58, 126 R, 127 R, 152 R; 40/107; 340/752, 756, 764, 765; 350/333, 335; 364/705, 569

[56] References Cited

U.S. PATENT DOCUMENTS

| | | | |
|---|---|---|---|
| 3,276,198 | 10/1966 | Barbera | 58/4 A |
| 3,738,099 | 6/1973 | Tanaka | 58/58 |
| 3,810,322 | 5/1974 | Ritchie | 40/107 |

*Primary Examiner*—Vit W. Miska

*Attorney, Agent, or Firm*—Frishauf, Holtz, Goodman & Woodward

[57] ABSTRACT

An electronic display device has numerals 1 to 31 for days of one month arranged in plural columns and rows, and numerals for displaying time such as "hours", "minutes" and "seconds" and including a plurality of segments. At least a part of the numerals for data display are disposed in the spaces defined by the segments for the numerals for time display. The device is useful for devices with restricted display space.

30 Claims, 26 Drawing Figures

| FIRST DIGIT | X | Y | Z |
|---|---|---|---|
| 1 | a | a | b c |
| 2 | a b | b | b |
| 3 | a | a | b |
| 4 | a | a c | |
| 5 | a | a c | b |
| 6 | a b | a c | b |
| 7 | a b | a c | |
| 8 | a b | a b | b c |
| 9 | a b | a b | b |
| 0 | a b | a | b c |
| DAY | | c | |

| SECOND DIGIT TO 8TH DIGIT | X | Y | Z |
|---|---|---|---|
| 1 | a | a | b c |
| 2 | a b | b | b |
| 3 | a | a | b |
| 4 | a | a c | |
| 5 | b | a c | b |
| 6 | b | a c | b |
| 7 | a b | a c | |
| 8 | a b | a b | b c |
| 9 | a b | a b | b |
| 0 | a b | a | b c |
| SUN | c | | |

ELECTRONIC DISPLAY DEVICE

BACKGROUND OF THE INVENTION

This invention relates to an electronic display device in which numerals for date display are partly disposed in the spaces defined by segments forming numerals for time display.

Digital timepieces for digitally displaying time by using a liquid crystal display (LCD), light emitting display (LED) and the like are on the verge of superseding conventional mechanical drive timepieces. The digital timepiece is constructed by using a quartz crystal oscillator, an electronic time counting circuit and the like. Accordingly, the counting accuracy is high and date data such as days, weeks and months may readily be counted in addition to time data such as hours, minutes, and seconds. This enables it to digitally display the days, weeks and months. For example, in the case of wristwatches, the date data is frequently displayed through switching from the time data display, since its display space is restrictively small. Business usage often demands the date covering a necessary time range, in order to make a schedule or confirm the specified past date. In the above-mentioned calendar system, the year and month determine the corresponding day and its day of the week. A substitutional calendar system is possible in which numerals 1 to 31 for one month days are arranged in a matrix like fashion with rows and columns. The columns are arranged corresponding to the days of a week and one specified column is disposed aligned with Sunday. If the calendar system is embodied by using electronic technology, we can instantly seen any desired date.

However, if the date data must additionally be displayed on the same display space as that for the time data, the display space must be expanded. This is unfavorable for a device with narrow display space such as a wristwatch.

For this, a metal plate on which the date data is printed is attached to a wristwatch band. This method, however, is defective in that the work of attaching the metal plate is troublesome and the metal plate attached is a nuisance and unattractive. Further, if the metal plate is unobtainable, users are inconvenienced.

In the field of electronic desk top type calculators, thin and small-sized calculators have appeared recently and prevalently sold in the market. Such type calculators often need the ordinary calculating function and the time counting functions such as time and date counting functions, stopwatch function, alarm function, and timer function, as well. As a matter of course, if such type of calculator has a calendar function like a timepiece, it is very convenient for users.

In summary, it is very difficult to doubly display the calendar data on the same display space as that the time data display, in the electronic devices needing a digital display of the data and time data and the calculating data, but having a restricted narrow display space.

Accordingly, an object of the invention is to provide an electronic display device in which the calendar data as well as the time data is effectively arranged in a common display space.

SUMMARY OF THE INVENTION

To achieve the above object, an electronic display device comprises a digital display portion having a plurality of digits of segmental display members for digitally displaying numerals by using proper combinations of segments and a calendar display portion in which at least a part of display members for date numerals are arranged in plural rows and columns in the spaces defined by segments of the segmental display member.

With such an arrangement, the calendar data as well as characters or numerals may be displayed in a common display space without enlarging the display device per se. Those display members may readily be combined without complicating the wiring in the display device, so that the calendar data may be displayed as a situation demands. Accordingly, it is very convenient in practical use. Further, there is eliminated the need of the unattractive and nuisance metal plate which is needed in the conventional wristwatch.

BRIEF DESCRIPTION OF THE DRAWINGS

Other objects and advantages of the invention will be apparent from the following description taken in connection with the accompanying drawings, in which.

DETAILED DESCRIPTION

Figure 1:
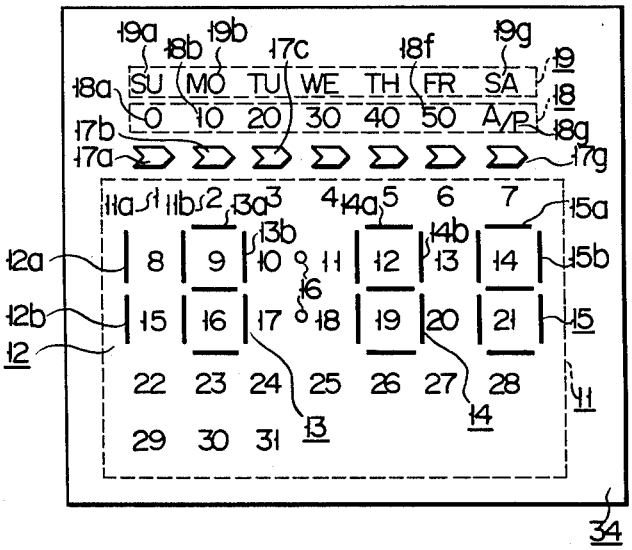
FIG. 1 shows a plan view of a display surface of an embodiment of an electronic device according to the invention.

An embodiment of the invention to follow is the case where a display device of the invention is applied to an electronic wristwatch. Referring now to FIG. 1, there is shown the surface of a display device 34 according to the invention. A date display portion 11 has numerals for one month date representation 1 to 31 which are arranged in matrix like fashion with rows having seven days corresponding to the days of the week, Sunday to Monday, and with columns. The numerals are denoted as 11*a*, 11*b* . . . and each constructed by a character electrode. Four digits time display members 12 to 15 for displaying hours and minutes and display members 16 for displaying a colon to mark the hour section off from the minute section are disposed on the data display portion 11. The time display members 12 to 15 are each constructed by a plurality of segment electrodes 12*a*, 12*b*, 13*a*, 13*b* . . ., 14*a*, 14*b* . . ., 15*a*, 15*b* . . .. As is known, a numeral is formed by properly combining the segments. Each segment is disposed in the space among the character electrodes 11*a*, 11*b* . . ..

On the upper portion of the date display portion 11, there are disposed arrow shaped indicators 17*a* to 17*g* for specifying any one of the days of the week, an auxiliary time display portion 18 including second indicators "0", "10" . . . "50" designated by 18*a* to 18*f* for indicating seconds and an indicator 18*g* denoted as "A/P" for indicating morning or afternoon, and an indicator 19 for indicating the days of the week, Sunday to Saturday, individually designated by 19*a* to 19*g*. When one of the arrow shaped indicators 17*a* to 17*g* is energized, other corresponding indicators are automatically energized, seconds, morning or afternoon, and the day of the week.

The respective character electrodes of the date display portion 11, the time display members 12 to 15, the auxiliary time display portion 18 and the indicator 19 are all constructed by liquid crystal display elements, for example. More specifically, a liquid crystal layer is sandwiched by a pair of transparent substrates made of glass. On the inner surface of the upper transparent substrate, formed are transparent electrodes forming numeral electrodes 11*a*, 11*b* . . ., segment electrodes 12*a* to 15*b*, colon display member 16, arrow shaped indicators 17*a* to 17*g*, the respective indicators 18*a* to 18*g* of the auxiliary time display portion 18, and the respective characters 19*a* to 19*g* of the indicator 19. On the other hand, a common transparent electrode is formed on the inner surface of the lower transparent substrate. Molecules of liquid crystal sandwiched between both the substrates are twisted about 90° therebetween in a spiral fashion. When an electric field is applied to the selected electrode, the spiral structure of the liquid crystal molecules decays to lose its optical rotary power and light is shielded by a polarizing plate (not shown), with the result that characters or numerals corresponding to the selected electrodes are displayed.

Figure 2:
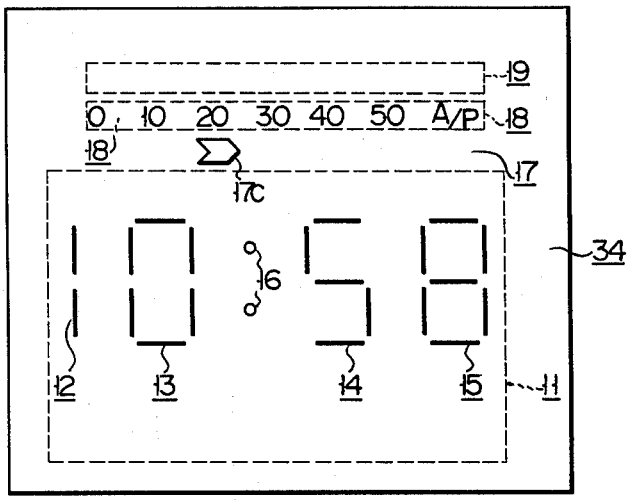
FIG. 2 shows one form of the displays on the display surface shown in FIG. 1.

In a normal time display mode, the display operation of the numeral electrodes 11*a*, 11*b* . . . and the indicator 19 is shut off. The time display members 12 to 15, the indicator 17*a* to 17*g*, and the auxiliary display portion 18 are activated to display the time at that time, "10:58 and 20 seconds a.m.", for example, as shown in FIG. 2.

Figure 3:
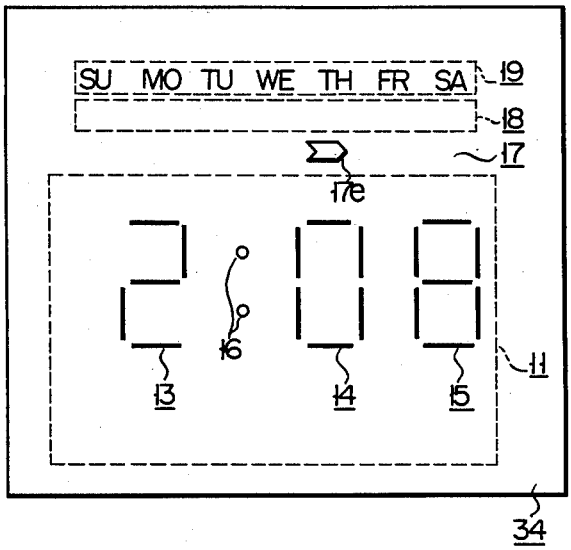
FIG. 3 shows another form of the displays of the same.

As shown in FIG. 3, if the indicator 19 for indicating the days of the week is used in place of the auxiliary time display portion 18 and the time display portions 12 to 15 is used for indicating "month" and "day", the date of the day is displayed, for example, "February 8th, Thursday" as shown in FIG. 3. A knob, for example, may be used to switch from the date display to the time display and vice versa.

Figure 4A:
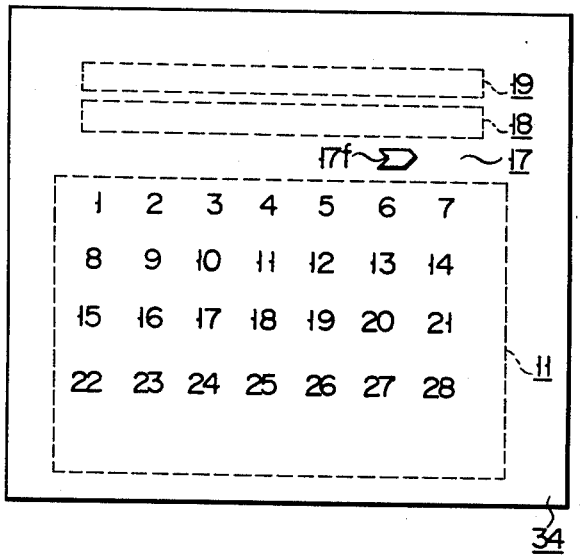
FIGS. 4(A) and 4(B) show one form of the displays where the date data is displayed on the display surface of FIG. 1.
Figure 4B:
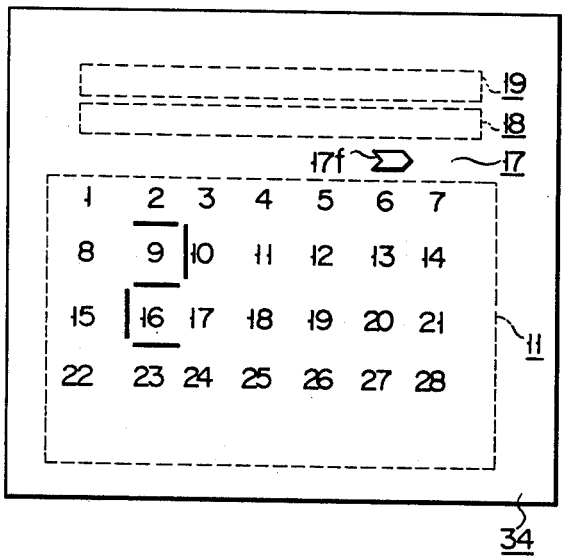

As shown in FIG. 4(A), if only the electrodes of the date display portion 11 and the indicators 17*a* to 17*g* are actuated, a calendar is displayed in place of the specified time and date, and the column corresponding to a specified day of the week, for example, Sunday, is indicated by using the indicators 17*a* to 17*g*. In this case, the month corresponding to the calendar, for example, 2 (February) may be displayed as shown in FIG. 4(B) by using the time display members 12 and 13.

In the calendar display, there are "28 days month", "29 days month" (in leap year), "30 days month" and "31 days month". Accordingly, it is impracticable that the arrangement "1 to 31" for the date display is constantly applied to every kinds of the month.

Figure 5:
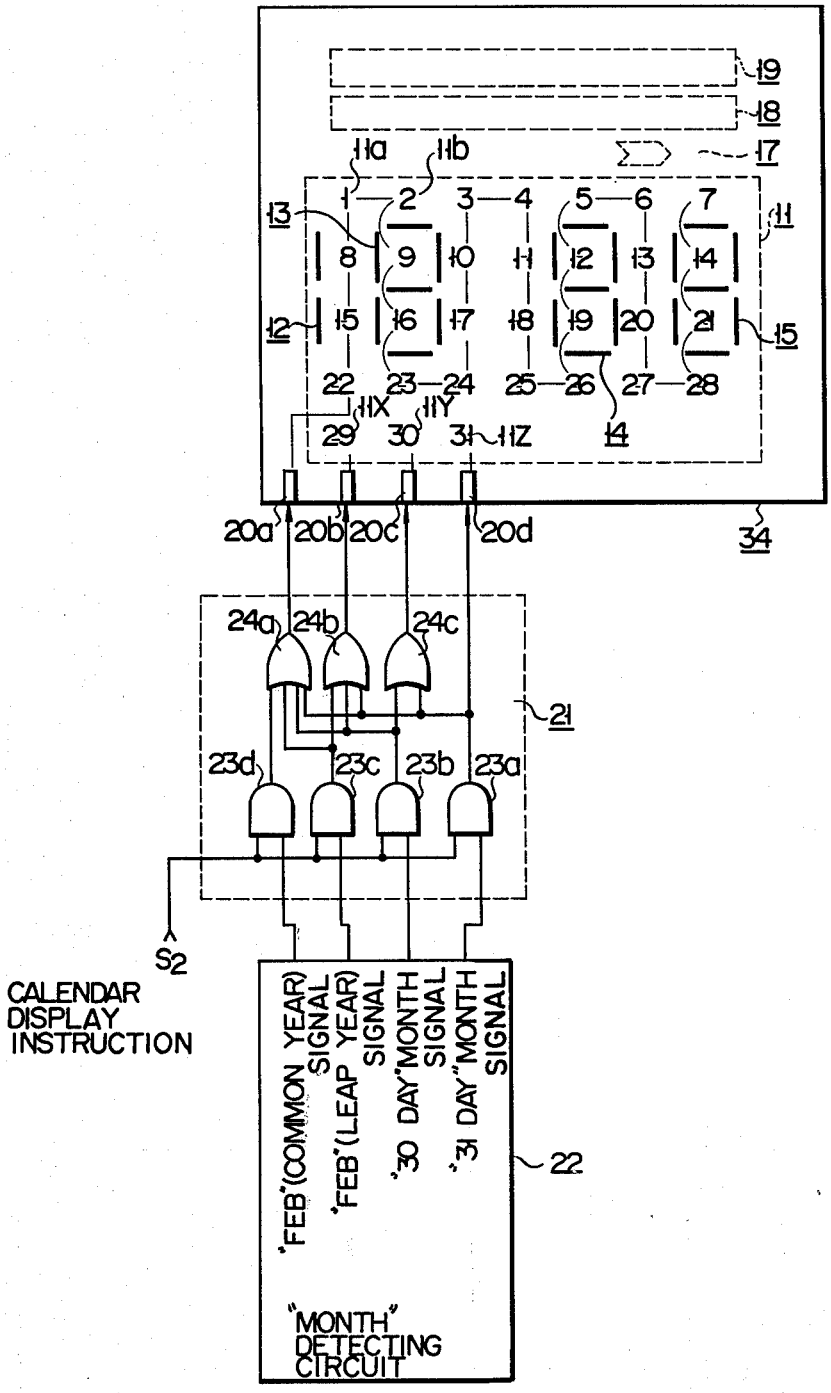
FIG. 5 shows a control circuit for controlling the drive of the character electrodes in the display surface which is an embodiment of the invention.

One of the solutions of this is illustrated in FIG. 5. As shown, a display drive signal is commonly applied to a common terminal 20*a* connected to the numeral electrodes for the dates 1 to 28, and display drive signals are separately applied to terminal 20*b* to 20*d* connected to the numeral electrodes 11*x* to 11*z* for the dates 29 to 31, respectively. The display drive signals applied to the terminals 20*b* to 20*d* are fed from a month-end adjusting logic circuit 21. The logic circuit 21 includes AND gates 23*a* to 23*d* which are connected at one input terminals to a 31 days month terminal, 30 days month terminal, FEB (leap year) terminal, and FEB (common year) terminal of a month control circuit 39 in a clock control unit to be described later. The other input terminals of these AND gates are commonly connected to an $S_2$ terminal for supplying a calendar display instruction signal. The outputs of the AND gates 23*a* to 23*d* are applied to an OR gate 24*a*. The outputs of the AND gates 23*a* to 23*c* are applied to an OR gate 24*b*. The outputs of the AND gates 23*a* and 23*b* are connected to an OR gate 24*c*. The output of the OR gate 24*a* is connected to the terminal 20*a*. The output of the OR gate 24*b* is connected to the terminal 20*b*. The output of the OR gate 24*c* is connected to the terminal 20*c*. The output of the AND gate 23*a* is connected to the terminal 20*d*.

With such a circuit connection, when an output signal is applied from the "31 days month" terminal of the month control circuit 39, the calendar display instruction applied enables the AND gate 23*a* to produce an output signal which in turn is applied directly to the terminal 20*d* and via the OR gates 24*a* to 24*c* to the terminals 20*a* to 20*c*. In this manner, the display drive signal is applied to all the dates 1 to 31. When an output signal is applied from the "FEB (common year)" of the month control circuit 39, the calendar display instruction applied at this time enables the AND gates 23*d* to produce the display drive which in turn goes via the OR gate 24*a* to the terminal 20*a* of the display device 34. Accordingly, the display drive signal is applied to only the dates 1 to 28. In a similar manner, the display up to 29 or 30 days is performed through the month-end adjusting logic circuit 21. The construction of the month control circuit 39 will be described in detail later.

Figure 6:
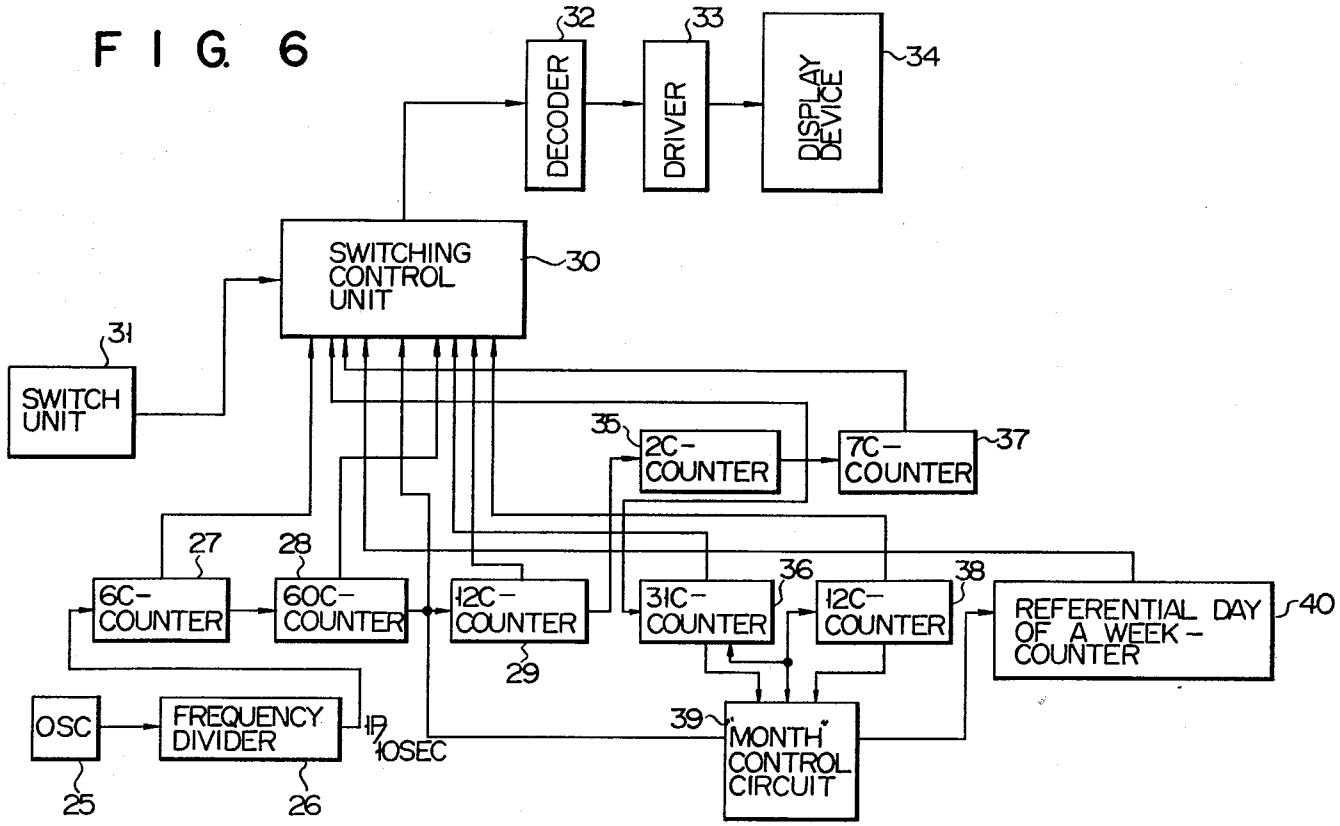
FIG. 6 shows a block diagram of a time counting circuit for carrying out a clock operation of the display device with the display surface shown in FIG. 1.

Referring now to FIG. 6, there is shown a clock control unit of a clock with a display device as mentioned above. A reference oscillator 25 produces a clock signal to be applied to a frequency divider 26 where it is frequency-divided to produce a time counting clock signal. The time counting clock signal has one pulse every ten seconds (1P/10 seconds). The time counting clock signal is then applied to a scale-of-6 counter 27 for "seconds" counting. The counter 27 produces a "second" signal expressed in ten seconds and produces a carry signal every one minute. The carry signal drives a scale-of-60 counter 28 for "minutes" counting. The counter 28 produces a "minute" counting signal expressed in one minute and produces a carry signal every 60 minutes, i.e. one hour. The carry signal drives a scale-of-12 counter for "hours" counting which produces a "hour" counting signal. The "second", "minute" and "hour" counting signals from the counters 27 to 28 are all applied to a switching control unit 30. In the absence of a switching instruction from a switch unit 31, the time counting signal is applied to a decoder 32 and a driver 33. The output of the driver 33 activates a display device 34 with a display surface as mentioned above, so that the time display as shown in FIG. 2 is carried out.

A carry produced from the counter 29 every 12 hours is applied to a binary counter 35 which in turn produces a "day" signal and an A/P signal representing morning or afternoon depending on the contents of the counter 35. The A/P signal is then applied to the switching control unit 30. The A/P signal actuates the indicator 17*g* when the time display is performed to indicate whether it is morning or afternoon.

A carry signal from the binary counter 35 is used as a "day" counting signal and is counted by a scale-of-31 counter 36. The carry signal is also counted by a scale-of-7 counter 37. The counter 37 produces a signal representing any one of the days of the week. The output signal of the counter 37 will be referred to as a "week" counting signal, for easy of explanation.

A scale-of-12 counter 38 for "month" counting is provided corresponding to the "day" counter 36. The count of the counter 38 is used as a "month" display signal and under control of the month control circuit 39. Depending on the count of the "month" counter 38, the month control circuit 39 judges the "31 days month", "30 days month", "28 days month" or "29 days month" and compares it with the date counted by the "day" counting circuit 36 to issue a reset instruction to the "day" counter 36, and a step instruction to the "month" counter 38. In this way, the month-end controlled counting is performed for the "month" and "day".

The count data of the "day" counter 36, "week" counter 37 and "month" counter 38 are guided to the switch control unit 30. Under this condition, when a date display instruction is produced from the switch unit 31, the date data including "month", "week" and "day" are selectively applied to the decoder 32 which in turn drives the display device 34 through the driver 33 to display the date as shown in FIG. 3.

The month control circuit 39 includes the circuit function as shown in FIG. 5 to provide display control instructions to the numeral electrodes 11X, 11Y and 11Z representing the month-end dates 29, 30 and 31 for the purpose of the month-end adjustment, and provides an instruction to the switch control unit while at the same time controls the count of a referential day of the week counter 40. The counter 40 stores the column of the date numerals corresponding to a specified day of the week as a reference, for example, Sunday, in a calendar display mode. In response to the signal outputted from the month control circuit 39 when month changes, the counter 40 corrects its contents to produce a selective signal for selecting a proper one of the indicators 17*a* to 17*g* which in turn is applied to the switch control unit 30. When the switch unit 31 issues a calendar display instruction, the switching control unit 30 provides a display instruction for the date display portion 11 to the decoder 32 and couples the signals from the month control circuit 39 and the referential day of the week counter 40 with the decoder 32. As a result, the calendar is displayed as shown in FIG. 4(A). In this case, when the data from the "month" counter 38 is also used, the display as shown in FIG. 4(B) is obtained.

Figure 7:
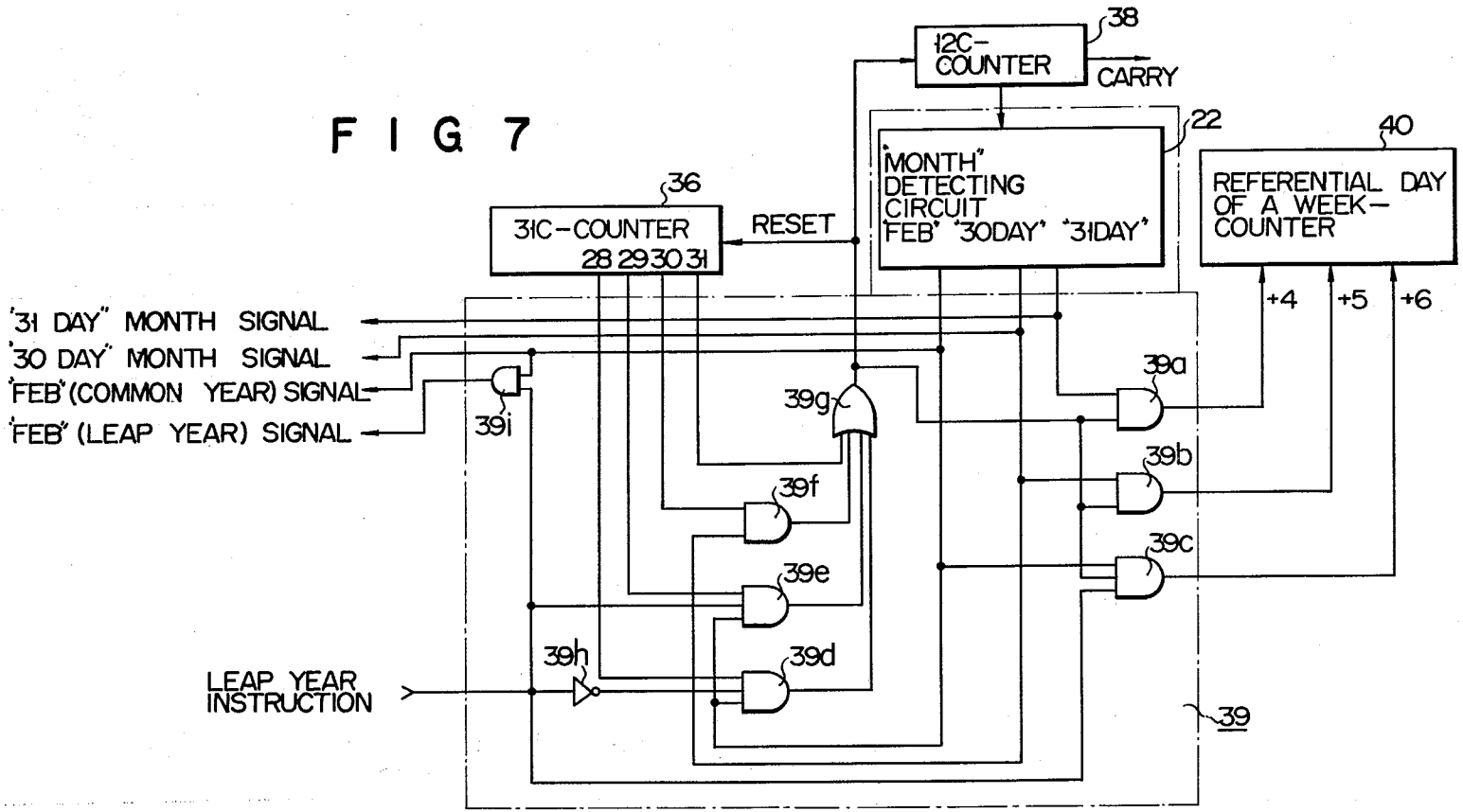
FIG. 7 shows a block and schematic circuit diagram of a month control circuit of the time counting circuit shown in FIG. 6.

FIG. 7 shows the month control circuit 39 and its related circuits. A month detecting circuit 22 is connected to the "month" counter 38. The circuit 22 detects the count data of the "month" counter 38 and judges as to whether the month is the "30 days month", "31 days month", "28 days month" or "29 days month". The outputs of the detecting circuit 22 are applied to AND gates 39*a*, 39*b* and 39*c* and also to the logical circuit 21 shown in FIG. 5 for the month-end adjustment. The "day" counter 36 produces at the respective output terminals for the dates "28", "29", "30" and "31" output signals when it steps from these counting states. These output signals representing these dates except the date 31 are applied to one input terminals of AND gates 39*d*, 39*e* and 39*f*, respectively. The outputs of these AND gates are applied to an OR gate 39*g*, together with the output terminal for "31" day of the counter 36. The output of the OR gate 39*g* is applied as a gate signal to the AND gates 39*a* to 39*c*, as a reset signal to the "day" counter 36, and as a step signal to the "month" counter 38. The outputs of the AND gates 39*a* to 39*c* are applied as counting correction instructions "+4", "+5" and "+6" to the referential day of the week.

The "30 days month" terminal of the detecting circuit 22 is coupled with the other input terminal of the AND circuit 39*f*. The "FEB" terminal of the detecting circuit 22 is applied to the other input terminals of the AND gates 39*e* and 39*d*.

In the calendar display, the leap year control on February must be made every four year. A leap year instruction signal for this control is formed by counting four carry signals each of which is outputted from, for example, the "month" counter 38 every one year. Thus formed leap year instruction signal is applied via an inverter 39*h* to an additional input terminal of the AND gate 39*d*, and directly to additional input terminals of the AND gates 39*c* and 39*e* and one input terminal of an AND gate 39*i*. The "FEB" terminal of the detecting circuit 22 is connected to the other input terminal of the AND circuit 39*i*. The output signal of the AND gate 39*i* is applied as a signal for designating February in the leap year to the month-end adjusting circuit 21 for adjusting the month-end.

Assume now that this month is October. The "month" detecting circuit 22 provides a gate signal to the AND gate 39*a*. Under this condition, the "day"

counter 36 counts 31 days and produces an output signal representing 31 when the next step instruction is coupled. The output signal is applied through the OR gate 39*g* to the AND gate 39*a* so that the AND gate 39*a* is enabled to produce the "+4" signal to be directed to the referential day of the week counter 40. The output signal passing through the OR gate 39*g* is applied as a reset signal to the counter 31 so that the content of the counter 31 is "1". The same output signal also reaches as a step signal the "month" counter 38 to set up the contents of it at "November". Accordingly, the indicators 17*a* to 17*g* is shifted four to indicate the column of the date numerals corresponding to Sunday, for example, in the calendar of November.

In this manner, when the "month" counting circuit 38 starts to count the "November", the detecting circuit 22 produces the "30 days month" output signal which is applied as a gate signal to the AND gates 39*b* and 39*f*. Under this condition, the counting operation of the "day" counting circuit 36 progresses to produce an output signal at the "30" output. Upon receipt of the output signal, the AND gate 39*f* is enabled to produce an output signal which in turn goes through the OR gate 39*g* to the "day" counter 36, and to the "month" counter 38. Upon receipt of the signal, the counter 36 is reset and the counter 38 is stepped, with the result that the counter states of them indicate "December 1". At the same time, the AND gate 39*b* produces an output signal of "+5" to be directed to the referential day of the week counter 40. As a result, the Sunday column is indicated by the indicator 17, as in the previous case.

Assume again that this month is February. In a common year, the last day of February is 28th. The Sunday column in the February calendar is the same as that in the March calendar. In a common year, the output of the inverter 39*h* is at "1" level. Accordingly, when the "day" counter 36 produces the "28" output, the AND gate 39*d* is enabled to produce an output signal which in turn goes through the OR gate 39*g* to the counter 36 and the counter 38. Accordingly, the counter 36 is reset and the counter 38 counts March so that the counter state is "March 1". At this time, the contents of the counter 40 is not changed.

In the case of February in a leap year, the leap year instruction presents. Accordingly, when the "day" counter 36 produces the "29" output, the AND circuit 39*e* is enabled so that the date counting is changed from "February 29" to "March 1". At the same time, the AND gate 39*c* has received the "FEB" signal and the leap year signal. Therefore, when the output of the AND gate 39*e* is applied through the OR gate 39*g* to the AND gate 39*c*, the AND gate 39*c* is enabled to provide the "+6" signal to the counter 40. The result is the indication of the Sunday column in March of the leap year by the indicator 17.

Figure 8:
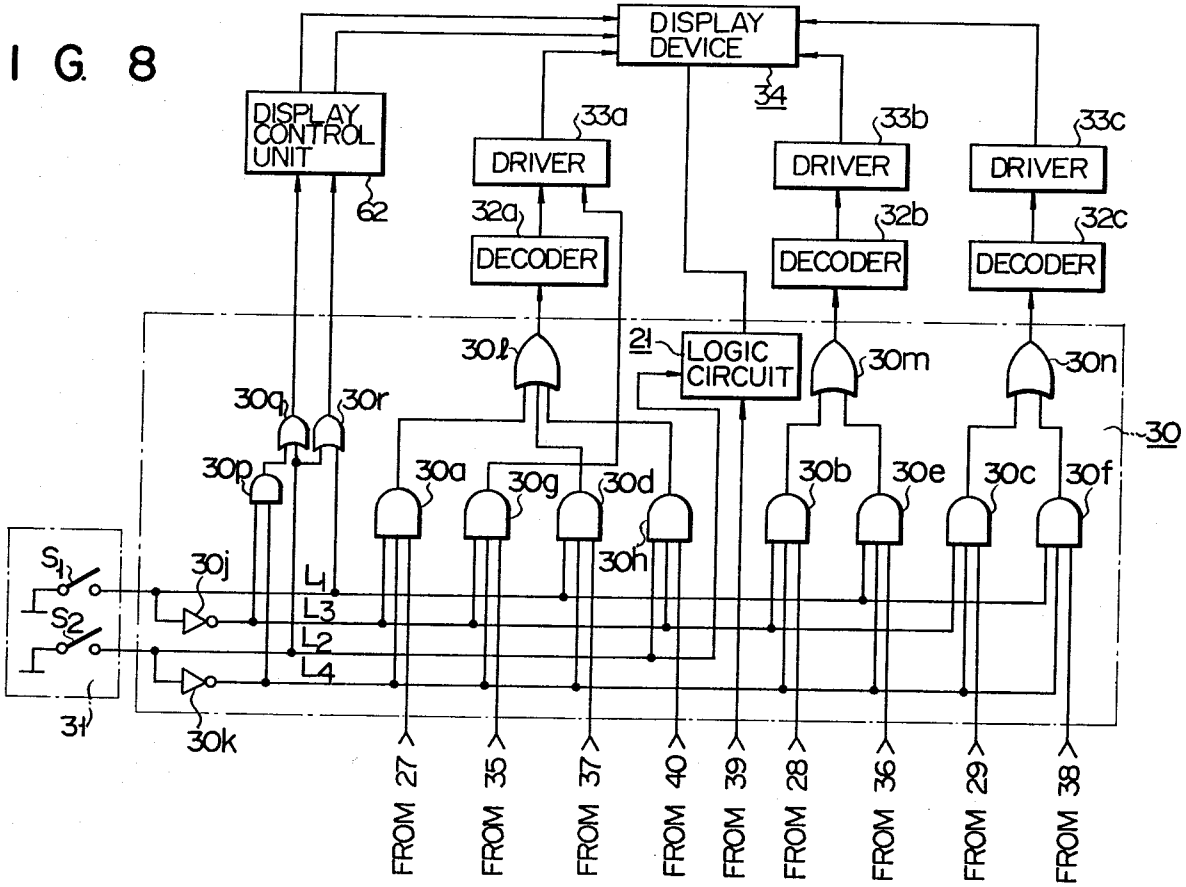
FIG. 8 shows a block and schematic circuit of a switching control unit in the time counting circuit shown in FIG. 6.

FIG. 8 shows the details of the switching control unit 30 and its associated circuit shown in FIG. 6. In FIG. 8, AND gates 30*a* to 30*c* are coupled at the first input terminals with time counting signals of "10 seconds", "minute" and "hour" from the counters 27, 28 and 29, respectively. AND gates 30*d* to 30*f* are coupled at the first input terminals with time counting signals of "month", "week" and "day" from the counters 37 to 38, respectively. AND gate 30*g* is coupled at the first input terminal with the "A/P" signal from the counter 35. AND gate 30*h* is coupled at the first input terminal with the counting signal from the referential day of the week counter 40. A logic circuit 21 is coupled at one input terminal with the month-end adjusting signal from the month control circuit 39, by means as shown in FIG. 5. The switch unit 31 comprises switches $S_1$ and $S_2$ which are actuated in the operation to provide a logical "1" signal. When actuated, logical "1" signals appear on lines $L_1$ and $L_2$, while, when not actuated, such signals appear on lines $L_3$ and $L_4$ via inverters 30*j* and 30*k*. The line $L_1$ connected to the switch $S_1$ is connected to the AND gates 30*d* to 30*f*. The line connected to the switch $S_2$ is connected to the AND gate 30*h* and the logic circuit 21. The line $L_3$ connected via the inverter 30*j* to the switch $S_1$ is connected to the second input terminals of the AND gates 30*a* to 30*c*, and 30*g* and the third input terminal of the AND gate 30*h*. The line $L_4$ connected to the switch $S_2$ via the inverter 30*k* is connected to the third input terminals of the AND gates 30*a* to 30*g*. In a normal state where both switches $S_1$ and $S_2$ are open as shown in the figure, the AND gates 30*a* to 30*c*, and 30*g* are enabled to select the data necessary for the time display such as "10 seconds", "minute", "second" and "A/P". When only the switch $S_1$ is actuated, the AND gates 30*d* to 30*f* are enabled to select the data necessary for date display such as "month", "week" and "day". When only the switch $S_2$ is actuated, the AND gate 30*h* is enabled and the logic circuit 21 is actuated so that the referential day of the week signal is selected and the month-end adjusting signal for calendar display is outputted from the logic circuit 21 as described referring to FIG. 5. The outputs of the AND gates 30*a*, 30*d* and 30*h* is connected to OR gate 30*l*; the outputs of the AND gates 30*b* and 30*e*, to the OR circuit 30*m*; the outputs of the AND gates 30*c* and 30*f*, to OR gate 30*n*. The outputs of OR gates 30*l* to 30*n* are connected to decoders 32*a* to 32*c*. The decoder 32*a* is used to select any one of the indicators 17*a* to 17*g* for indicating the days of the week. The decoder 32*b* is used to selectively provide display signals for driving the time display electrodes 14 and 15 for minute. The decoder 32*c* selectively provides display signals for driving the "hour" display electrodes 12 and 13. The outputs of these decoders are applied via corresponding drivers 33*a* to 33*c* to the display device 34.

As described above, auxiliary display portions 18 and 19 are provided for "second" and "week" displays. These display portions are properly and selectively used in accordance with the display mode, as shown in FIGS. 2 to 4. The selection of them is carried out by the switching control unit 30 is accordance with the operation of the switch unit 31. More specifically, the outputs of the inverters 30*j* and 30*k* are detected by an AND gate 30*p* and a signal is taken in a normal state where both switches $S_1$ and $S_2$ are not actuated. The signal is applied to an OR circuit 30*q*, together with the signal on the line $L_2$. The OR circuit 30*q* provides a display prohibit signal to the "week" display portion 19, through a display control unit 62. When both switches $S_1$ and $S_2$ are actuated, the signals on the lines $L_1$ and $L_2$ are detected by an OR circuit 30*r*. Upon detection of the signals, the OR circuit 30*r* provides a display prohibit signal to the time auxiliary display portion 18, via the display control unit 62. Depending on the signals from the OR circuits 30*q* and 30*r*, the display control unit 62 controls the display of the upper and lower auxiliary display portions 19 and 18 in the display device 34.

More precisely, when both switches $S_1$ and $S_2$ are open, the auxiliary display portion 18 is driven as shown in FIG. 2. When only the switch $S_1$ is actuated, the auxiliary display portion 19 is driven, as in FIG. 3.

When only the switch $S_2$ is actuated, both the display portions are not driven, as shown in FIGS. 4(A) and 4(B).

With such a construction, in the normal state, the AND gates 30*a*, 30*c* and 30*g* are enabled so that the time display is performed as shown in FIG. 2 by using the time counting signals "hour", "minutes", "10 seconds" and "A/P". When only the switch $S_1$ is actuated, the date display is made as shown in FIG. 3 by using numeral display segments for the time display. When only the switch $S_2$ is actuated, the calender display is carried out as shown in FIG. 4(A) without using the time display electrodes 12 to 15.

It is to be noted here that the time and date displays by using numerals and the calendar display are performed by using the same display space of the display device 34. As described above, the segment electrodes 12 to 15 are partly disposed in the spaces defined by the numeral electrodes 11*a*, 11*b*... Therefore, the segments as display elements may be effectively disposed by using only one set of liquid crystal display members.

Figure 9A:
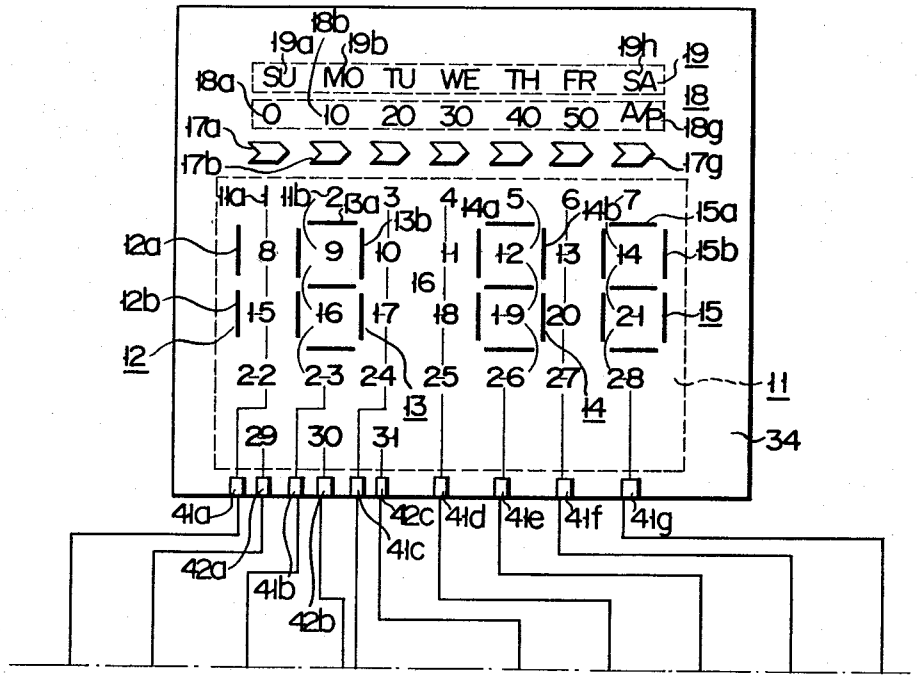
FIGS. 9(A) and 9(B) illustrate one form of the displays on the display surface and a circuit diagram of a control circuit of the calendar display according to another embodiment of the invention.
Figure 9B:
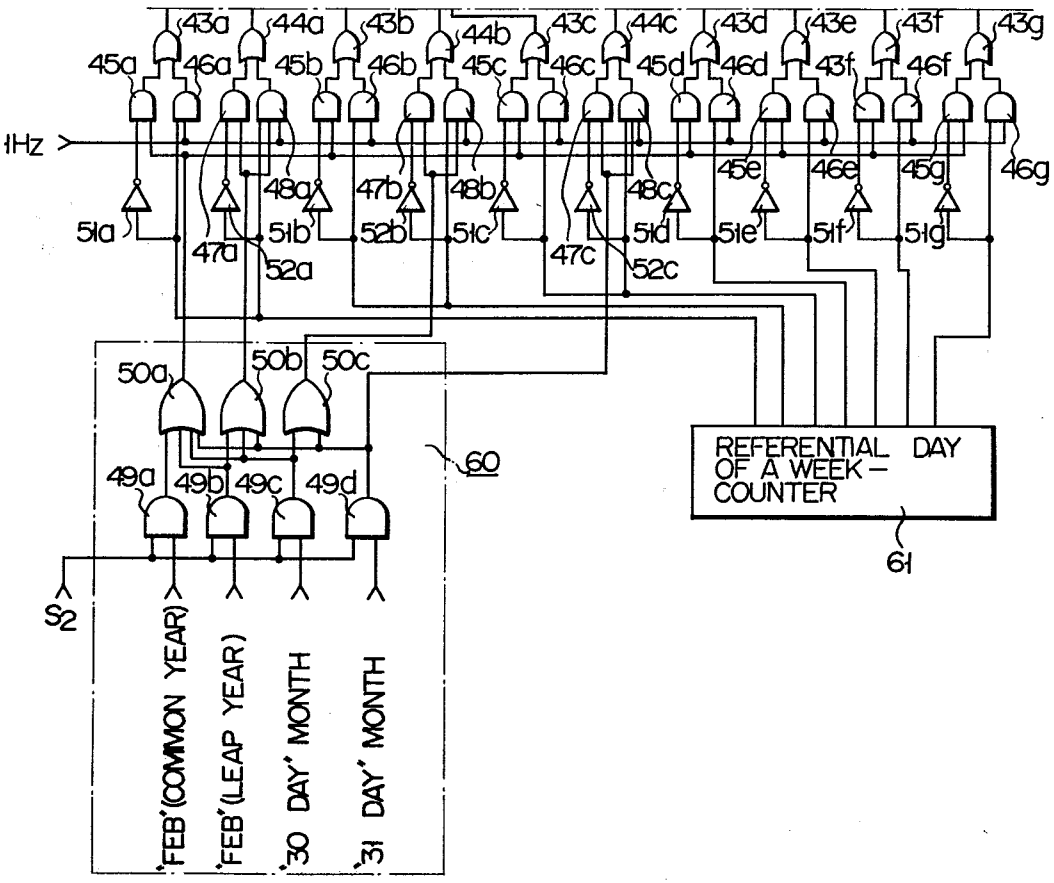

Another embodiment of the invention will be given with reference to FIGS. 9(A) and 9(B) in which the date display portion 11 and its display control circuit are illustrated in detail. The numeral electrodes as numeral display means for dates "1" to "31" are constructed by liquid crystal display means, and those except the mouth end dates "29" to "31" arranged in a matrix of which rows each include seven numeral electrodes corresponding to the days of the week. The numeral electrodes on the same column are commonly connected to be guided to terminals 41*a* to 41*g*. Display drive signals are applied via the terminals 41*a* to 41*g* to those column electrodes. The numeral electrodes for dates "29⇄ to "31" are connected to terminals 42*a* to 42*c*, respectively. The outputs of OR circuits 43*a* to 43*g* shown in FIG. 9(B) are connected to the terminals 41*a* to 41*g* and the outputs of OR gates 44*a* to 44*c* shown in FIG. 9(B), to the terminals 42*a* to 42*c*, respectively.

The outputs of AND gates 45*a* to 45*g* and 46*a* to 46*g* are applied to the OR gates 43*a* to 43*g*, respectively. The outputs of AND gates 47*a* to 47*c* and 48*a* to 48*c* are connected to the OR gates 44*a* to 44*c*, respectively. A clock signal of 1 Hz is applied to the AND gates 46*a* to 46*g* and 48*a* to 48*g*. These AND gates and the OR gates cooperate to form the decoder/driver for the date display portion 11. A month-end adjusting control circuit 60 and a referential day of the week calendar 61 are coupled with the decoder/driver. The month-end adjusting control circuit 60 is comprised of AND gates 49*a* to 49*d* to which a gate signal is applied when the switch $S_2$ is actuated. The AND gates 49*a* to 49*d* receive at other input terminals "FEB (common year)", "FEB (leap year)", "30 days month" and "31 days month". The outputs of the AND gates 49*a* to 49*d* are all coupled with an OR gate 50*a*. The outputs of the AND gates 49*b* to 49*d* are coupled with an OR gate 50*b*. The outputs of the AND gates 49*c* and 49*d* are coupled with an OR gate 50*c*. In the "31 days month", the AND gate 49*d* and the OR gates 50*a* to 50*c* provide output signals to the decoder/driver. In the "30 days month", the OR gates 50*a* to 50*c* provide output signals to the same. In February of the leap year, the OR circuits 50*a* and 50*b* provide output signals to the same. In February of the common year, only the OR gate 50*a* provides an output signal to the same.

The output signal of the OR gate 50*a* is supplied as a gate signal to the AND gates 45*a* to 45*g*. The output signals from the OR gates 50*b* and 50*c* and the AND gate 49*d* are applied as gate signals to the AND gates 47*a* to 47*c* and 48*a* to 48*c*.

The referential day of the week counter 61 corresponds to that 40 in FIG. 7, and is provided with seven output lines providing count signals corresponding to the respective columns of the calendar. The seven output lines are coupled with the AND gates 46*a* to 46*g*, respectively, and the first three output lines are further coupled with the AND gates 48*a* to 48*c*, respectively. The output lines connected to the AND gates 46*a* to 46*g* and 48*a* to 48*c* are also connected to the AND gates 45*a* to 45*g* and 47*a* to 47*g* through inverters 51*a* to 51*g* and 52*a* to 52*c*, respectively.

In the above-mentioned construction, it is unnecessary to use the indicator 17 to indicate Sunday for dates "1" to "31". That is, when the switch $S_2$ is actuated, the date display portion 11 is set up as shown FIG. 10. In this case, when the month is the "31 days" one, actuation of the switch $S_2$ causes the AND gate 49*d* to produce an output signal and at the same time the OR circuits 50*a* to 50*c* produce output signals. For this, the AND gates 45*a* to 45*g*, 47*a* to 47*c* and 48*a* to 48*c* are all enabled to permit display drive signals to be applied to the terminals 41*a* to 41*g*, and 42*a* to 42*c*. The numeral electrodes of "1" to "31" in the date display portion 11 are all energized.

In the referential day of the week 61, only the output lines corresponding to the "Sunday" in the month is activated to provide logical "1" thereon. Assume now that the logical "1" appears on the second output lines from the head, for example. No gate signal is applied to the AND gates 45*b* and 47*b*. On the other hand, the AND gates 46*b* and 48*b* are enabled. Accordingly, the second column in the calendar is driven by the 1 Hz clock so that only the second column is flashed as indicated by a broken line in FIG. 10. In this manner, the specified column corresponding to the day of the week, for example, Sunday, is specified.

In the just mentioned example, the specified column is specified by flashing but other columns than the specified one may be flashed. Further, in the above-mentioned examples, the liquid crystal is used as a display means but other suitable means may be used such as LED, cataphoresis, and the like.

Figures 11, 13A, 13B:
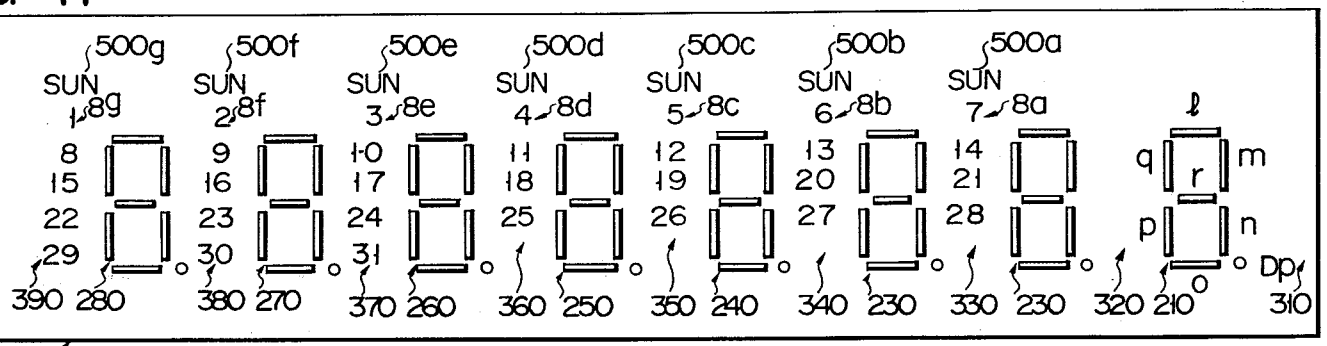
FIG. 11 shows a display surface of the display device which is another embodiment of the invention.
FIGS. 13(A) and 13(B) tabulate drive signals supplied to the electrodes in the respective digits shown in FIGS. 12(A) and 12(B)

The explanation to follow is the case where the invention is applied to an electronic calculator with time counting function, the called multifunction electronic calculator. FIG. 11 shows one form of the displays in this example. Further, in this example, liquid crystal is employed for the display means. In this display designated by 110, a series of numeral or character display members are separately arranged and each of the display members is comprised of segments l to r and $D_p$. The display members are designated by reference numerals 210 to 280, and capable of displaying number up to eight digits. Additionally, numeral electrodes 8*a* to 8*g* are disposed in the spaces 320 to 380 each between adjacent numeral display members 210 to 280, in the space 310 on the right side of the display member 210 of the most significant digit and in the space 390 on the left side of the display member 280 of the least significant digit. These spaces will be referred to as digit in-between spaces, for simplicity. More specifically, the numeral electrodes 8*g* representing the dates 1, 8, 15, 22 and 29 are vertically arranged in the digit in-between space 390 to form a column. The seven days starting at each of the column dates 1, 8, 15, 22 and 29 are horizontally arranged in the rest of the digit in-between spaces 380, 370 . . . 320 to form a row. In the display in FIG. 11, above the uppermost row of the numeral electrodes for the dates 1 to 7, are horizontally disposed a series of character display members 500*a* to 500*g* each representing Sunday SUN. As shown, the character display members 500*a* to 500*g* are vertically aligned with the corresponding columns of the numeral electrodes.

Figure 12A:
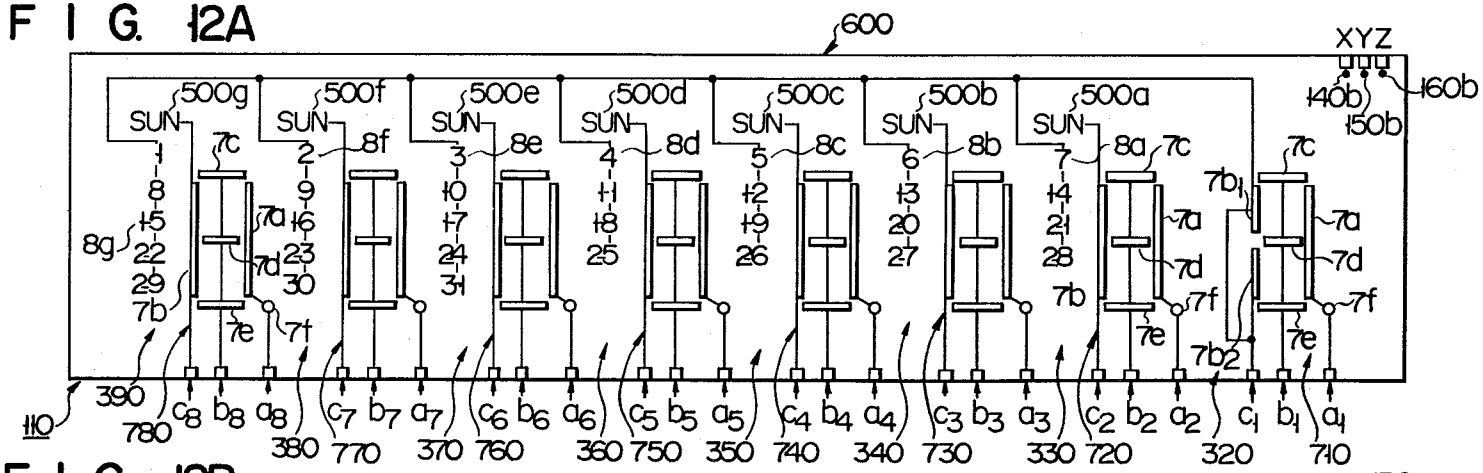
FIGS. 12(A) and 12(B) illustrate the structures and connections of first and second electrodes in the display surface of FIG. 11.
Figure 12B:
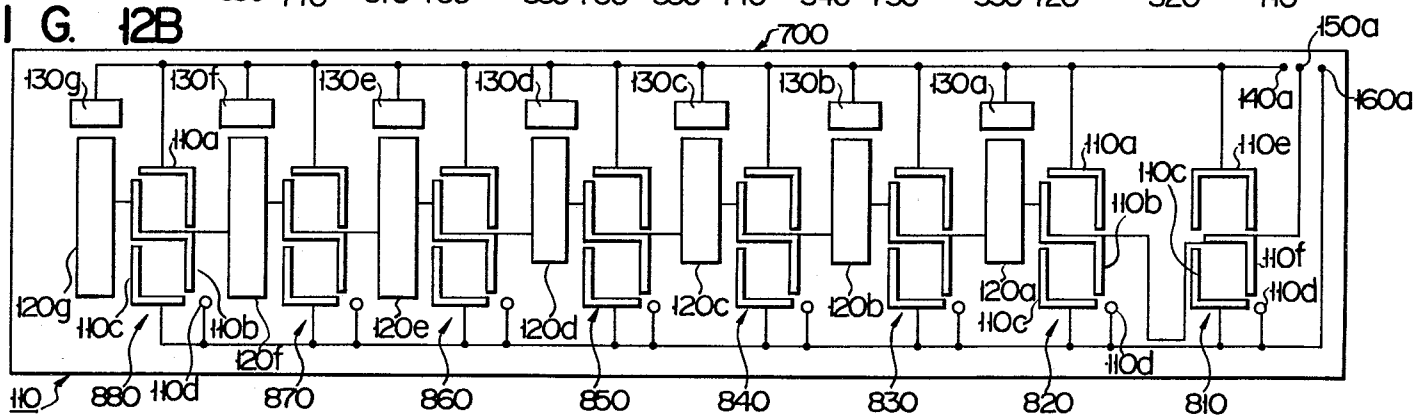

Referring now to FIGS. 12(A) and 12(B), there are illustrated the structures and connections of first and second electrodes in the display 110. The drive system of the display system in this example is of dynamic drive system of $\frac{1}{8}$ duty. FIG. 12(A) shows the structure of one of transparent electrode plates 600 on which first electrodes are formed each being shaped like a numeral 8 and designated by 710 to 780. The first electrodes except the electrode 710 are each comprised of five segmental electrodes 7*a* to 7*e* and one dot like electrode 7*f* for representing a decimal point. The dot electrode 7*f* corresponds to the segment $D_p$ in FIG. 11 and is connected to the vertical electrode 7*a*. First electrodes drive signals $a_2$ to $a_8$ are successively applied to the dot electrodes 7*f* of the respective digits. The vertical segmental electrodes 7*a* to 7*b* are formed by segments m and n in FIG. 11. The horizontal segmental electrodes 7*c* to 7*e* of the segments l, r and o are commonly connected. First electrodes drive signals $b_2$ to $b_8$ are successively applied to the vertical electrodes of the respective digits. The vertical segmental electrode 7*b* of the segments q and p of each digit receives one of first electrode drive signal $c_2$ to $c_8$. The first electrode 710 has a connection substantially equal to that of other first electrodes 720 to 780. One of the vertical electrodes is divided into two parts; one is an electrode $7b_1$ corresponding to the segment q and the other is an electrode $7b_2$ corresponding to the segment p. The reason why it is divided is to avoid its intersecting the wiring of second electrodes to be described later. The partitioned electrodes $7b_1$ and $7b_2$ are connected at the place outside the visual region of the display 110 and receives there a first electrode signal $c_1$. The other electrodes 7*a*, 7*c* to 7*f* of the first electrode 710 are the same as those of the other first electrodes 720 to 780 in the structure and the connection. The vertical segmental electrode 7*a* is connected to the dot like electrode 7*f* for a decimal point to which a first electrode drive signal $a_1$ is applied. The vertical segmental electrodes 7*c*, 7*d* and 7*e* are connected together to which a first electrode drive signal $b_1$ is applied.

As previously stated, numeral electrodes representing the dates "1" to "31" are disposed in the digit in-between spaces 330 to 390 with an arrangement of a matrix. Those numeral electrodes are commonly connected and coupled with the partitioned electrode $7b_1$ of the first electrode 710 to which the first electrode drive signal $c_1$ is applied. First electrodes 500*a* to 500*g* for representing Sunday denoted as SUN which are disposed above the uppermost numeral electrodes of the respective columns, as stated above, are each connected to the vertical segmental electrode 7*b* of each first electrode 720 to 780 which is positioned at the right lower side of the corresponding SUN electrode, as viewed in the drawing. The first electrode drive signals $c_2$ to $c_8$ are successively applied to the vertical segmental electrodes 7*b* of the respective digits which are connected to the corresponding first electrodes 500*a* to 500*g*.

FIG. 12(B) illustrates the structure of the other transparent electrode 700 of the display 110. On the transparent electrode 700 are formed second electrodes 810 to 880 shaped like numeral 8 which are disposed correspondingly opposite to the first electrodes 710 to 780, respectively. The second electrodes other than the one 810 are each comprised of three segmental electrodes 110*a* to 110*c* and a dot like electrode 110*d* for a decimal point. The segmental electrode 110*a* corresponds to the coupled segments l and m of the display member 210 in FIG. 11; the segmental electrode 110*b* to the coupled segments n, r and q; the segmental electrode 110*c* to the coupled segments o and p. the second electrode 810 has segmental electrodes similar in shape to those 110*c* and 110*d* of the other second electrodes and segmental electrodes 110*e* and 110*f* different in shape from those 110*a* and 110*b*. The segmental electrode 110*e* corresponds to the coupled segments l, m and g and the electrode 110*f*, to the coupled segments m and r. Second electrodes 120*a* to 120*g* for date display are disposed in the spaces between adjacent second electrodes 820 and 830, 830 and 840, . . . 870 and 880, and on the left side of the electrode 880. These spaces correspond to the digit inbetween spaces in FIG. 11. The second electrodes 120*a* to 120*g* are disposed correspondingly opposite to the corresponding numeral electrodes 8*a* to 8*g*. Second electrodes 130*a* to 130*g* are disposed above the corresponding electrodes 120*a* to 120*g* and opposite to the first electrodes 500*a* to 500*g* in FIG. 12(A). As shown, the segmental electrodes 110*a* of the second electrodes 820 to 880, the segmental electrode 110*e* of the second electrode 810, and all the second electrodes 130*a* to 130*g* for SUN representation are all connected commonly and led to a terminal 140*a* on the transparent electrode 700. The terminal 140*a* is connected via a lead wire (not shown) to a terminal 140*b* provided on the transparent electrode 600. A second electrode drive signal X is applied to the terminals. The segmental electrode 110*f* of the second electrode 810, the segmental electrodes 110*b* of the outer electrodes 820 to 880, and the date display electrodes 120*a* to 120*g* are all connected in series and led to a terminal 150*a* on the transparent electrode plate 700. The terminal 150*a* is connected via a lead wire (not shown) to a terminal 150*b* on the other transparent electrode plate 600. A second electrode drive signal Y is applied to the terminals connected. The segmental electrodes 110*c* of the electrodes 810 to 880 and the dot like electrodes 110*d* corresponding to the segments $D_p$ in FIG. 11 are all connected commonly and led to a terminal 160*a* on the plate 700. The terminal 160*a* is connected via a lead wire (not shown) to a terminal 160*b* on the other plate 600. Another second electrode drive signal Z is applied to the terminals connected. The segmental electrode 110*b* of the second electrode 820 and the segmental electrode 110*f* of the second electrode 810 are connected at the place outside the visual region of the display as in the connection of the partitioned electrodes $7b_1$ and $7b_2$, in order to prevent appearance of abnormal display due to its crossing with the wiring of the electrodes $7b_1$ and $7b_2$ of the first electrode 710. Additionally, the electrodes 7*a* to 7*g*, the numeral electrodes 8*a* to 8*g*, and the first electrodes 500*a* to 500*g*, the segmental electrodes 110*a* to 110*f*, the date display electrodes 120*a* to 120*g*, and the second electrodes 130*a* to 130*g* must be wired so as not to cross one another for preventing the abnormal display. For obtaining a desired display by using thus constructed display device, suitable voltages are selectively applied to the electrodes on the transparent electrode plates 600 and 700, such as the first electrodes 710 to 780, numeral electrodes 8*a* to 8*g*, electrodes 500*a* to 500*g* and the second electrodes 810 to 880, electrodes 120*a* to 120*g* and electrodes 130*a* to 130*g*.

FIGS. 13(A) and 13(B) illustrate the relation between the first electrode drive signals a, b and c and the second electrode drive signals X, Y and Z when numerals, decimal point and calendar data at the first and second to eighth digits are displayed. For example, when numeral "1" is displayed, the first electrode drive signal a is applied at the timing of the second electrode drive signals X, Y and Z in all digits, first to eighth digits. When numeral "8" is displayed, the first electrode drive signals a, b and c must be applied at the timing of the second electrode drive signal X application in the first digit, as shown in FIG. 13(A). Further, the first electrode drive signals b and c must be applied at the timing of the application of the second electrode drive signal Y, and the first electrode drive signals b and c must be applied at the timing of the application of the second electrode drive signal Z. In the second to eighth digits, the first electrodes drive signals a and b must be applied at the timing of the second electrode drive signal X; the first electrode drive signals a, b and c, at the timing of the second electrode drive signal Y; the first electrode drive signals b and c, at the timing of the second electrode drive signal Z, as shown in FIG. 13(B). As seen from the above, there are some difference of the drive signal combination in the first and the second and eighth digits for the same numeral or character display. The numerals other than the above-mentioned ones and the decimal point may be displayed by properly applying the first electrode drive signals at the timings of the second electrode drive signals X, Y and Z, as shown in FIGS. 13(A) and 13(B).

In order to drive the numeral electrodes 8*a* to 8*g* for the dates "1" to "31", the first electrode drive signal c must be applied at the timing of the second electrode drive signal Y, as shown in FIG. 13(A). At this time, in the first digit, there is no correspondence between the segmental electrode 110*f* in FIG. 12(B) and the partitioned electrodes $7b_1$ and $7b_2$ in FIG. 12(A). Therefore, nothing is displayed. However, there is produced a potential difference between numeral electrodes 8*a* to 8*g* connected to the partitioned electrode $7b_1$ to which the first electrode drive signal $c_1$ is applied via the applied via the electrode $7b_2$ and the second electrodes 120*a* to 120*g* for the date display. See FIGS. 12(A) and 12(B). As a result, the dates "1" to "31" are displayed.

When the SUN electrodes 500*a* to 500*g* are displayed, the first electrode drive signal c must be applied at the timing of the second electrode drive signal X. That is, there is no correspondence between segmental electrodes 110*a* and 7*b* in the second to eighth digits. This causes nothing to be displayed. However, there is produced a given potential difference between the electrodes 500*a* to 500*g* connected to the vertical electrodes 7*b* of the first electrodes 720 to 780 to which the first electrode drive signals $c_2$ to $c_8$ are applied and the second electrodes 130*a* to 130*g* to which the second electrode drive signal X is applied. As a result, the SUN electrodes 500*a* to 500*g* are driven.

Figure 14:
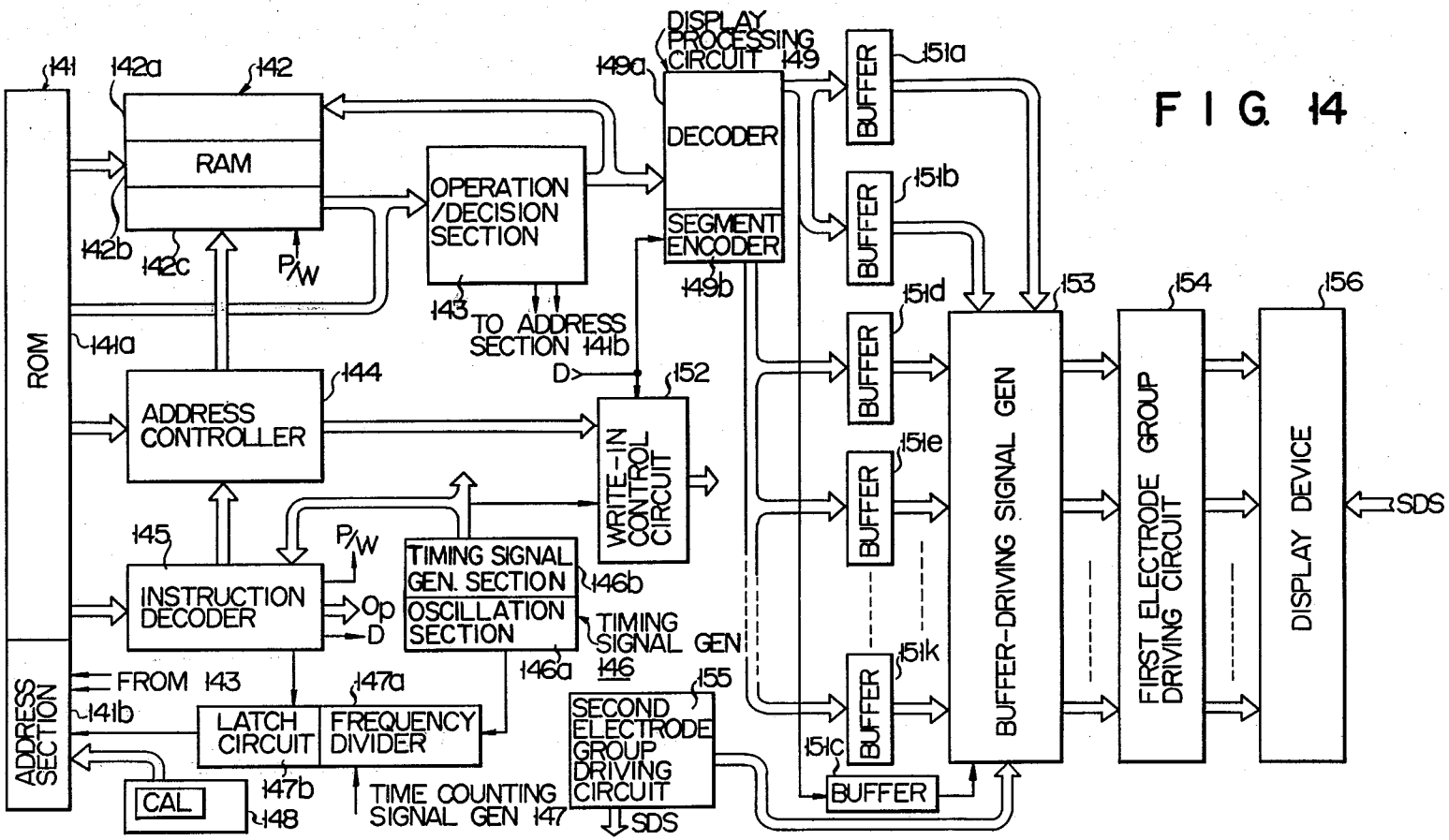
FIG. 14 shows a block diagram of a circuit construction when the display device of the invention is applied to a microcomputer.

FIG. 14 shows a block diagram of an electronic calculator with time counting function. In the figure, a control unit 141 for controlling the respective portions of the calculator includes an ROM (random access memory) portion 141*a* for fixedly storing microprograms and an address portion 141*b* for addressing the ROM portion 141*a*. An RAM (random access memory) 142 includes a first area 142*a* for storing time counting data or calendar data, a second area 142*b* having an accumulator register and the like for arithmetic operation, a third area 142*c* having registers for storing other various data. The data read out of the RAM 142 is fed to an operation/decision section 143 where it is properly processed and again fed to the RAM 142. An address controller 144 specifies the column address (called digit designation) to the RAM 142, and controls the column address to the RAM 142 depending on a single column address outputted from the ROM portion 141*a* or the processing initiation/end column address. An instruction decoder 145 decodes an instruction outputted from the ROM portion 141*a* and produces a control signal "OP" to the respective circuits, a read/write indication signal R/W to the RAM 142, a control signal to an address controller 144, and a display signal D to a display relating circuit to be described later. In addition to the signals to the address controller 144 and the instruction decoder 145, the ROM 141*a* produces a signal for specifying the column address to the RAM 142 and numeral codes for arithmetic operation, flag codes and the like to the operation/decision circuit 143. A timing signal generator 146 includes an oscillation section 146*a* for generating a reference frequency for time counting and a clock signal for operating the respective portions and a timing signal generating section 146*b* for producing various kinds of timing signals from the output of the oscillation section 146*a*. The output of the timing signal generating section 146*b* is applied to the instruction decoder 145 and to other respective portions. The reference frequency signal outputted from the oscillation section 146*a* is fed to a frequency divider 147*a* for obtaining one second interval signal, for example. The output of the frequency divider 147*a* is applied to a latch circuit 147*b* where the output is latched. The frequency divider 147*a* and the latch circuit 147*b* form a time counting signal generator 147. The output of the time counting signal generator 147 is applied to the address section 141*b* of the control unit 141. A key input unit 148 is provided with various keys such as function keys, and other keys for controlling the time counting or calendar function and other necessary keys. The output of the key input unit 148 is applied to the address section 141*b*. The key input unit 148 is provided with a "CAL" (calendar display) as a key for controlling a calendar function. To the address section 141*b* of the control section 141 are applied the outputs of the time counting signal generating section 147 and the key input unit 148 and a branch signal of 2 bits from the operation/decision section 143.

The display processing circuit 149 converts the data fed through the operation/decision section 143 into display data. The display processing circuit 149 includes a decoder 149*a* for decoding applied data (BCD code) into 0 to 9 and 10 and a segment encoder 149*b* for encoding the output of the decoder 149*a* into the segment signals l, m, n . . . q. The circuit 149 operates responsive to the display signal "D" from the instruction decoder 145. The output of the decoder 149*a* is applied to a display buffer 151*a* for storing the data to select the first electrodes 500*a* to 500*g* as shown in FIG. 12(A) for "SUN" display, a display buffer 151*b* for storing the display position of decimal point, and a display buffer 151*c* for storing the display of the calendar data. The output of the segment encoder 149*b* is applied to eight display buffers 151*d*, . . . 151*k* for storing the segments l to g, These display buffers 151*a* to 151*k* are controlled by a write-in control circuit 152 which receives the address data outputted from the address controller 144 and the signal outputted from the timing signal generator 146 to produce write-in clock signals. The output signals of these buffers 151*a* to 151*k* are applied to a first electrode drive signal generator 153 which produces first electrode drive signals $a_1$ to $a_8$, $b_1$ to $b_8$, and $c_1$ to $c_8$, and combined properly. The output of the first electrode drive signal generator 153 is applied via a first electrode drive circuit 154 to a display device 156 where it drives the various electrodes as mentioned referring to FIGS. 12(A). A second electrode drive circuit 154 produces second electrode drive signals X, Y and Z which are in turn applied to a first electrode drive signal generating circuit 153. The second electrode drive signal SDS is applied to a display device 156 where it drives the electrodes 110*a* to 111*f*, numeral electrodes 120*a* to 120*g* and electrodes 130*a* to 130*g*.

Figure 15A:
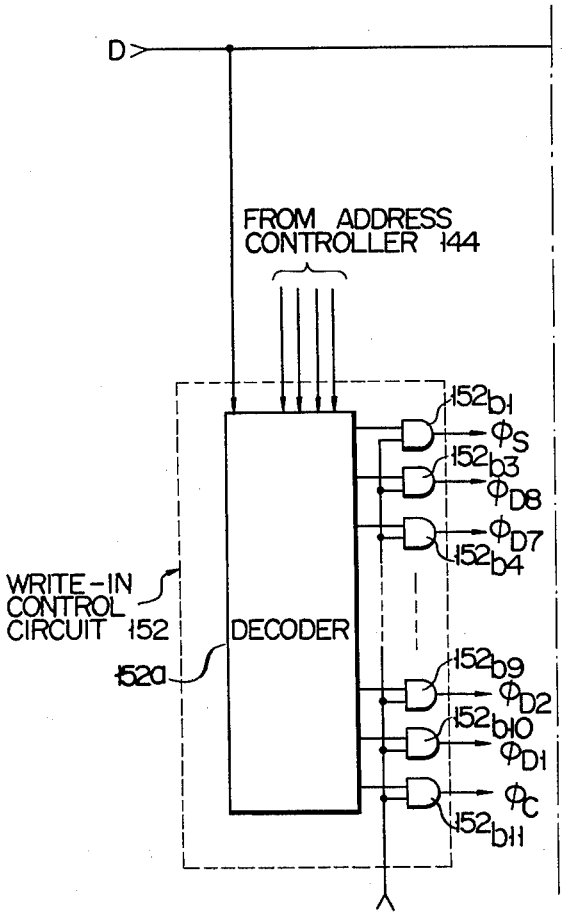
FIGS. 15(A) and 15(B) illustrate wiring of major blocks for illustrating the operation of the FIG. 19 circuit.
Figure 15B:
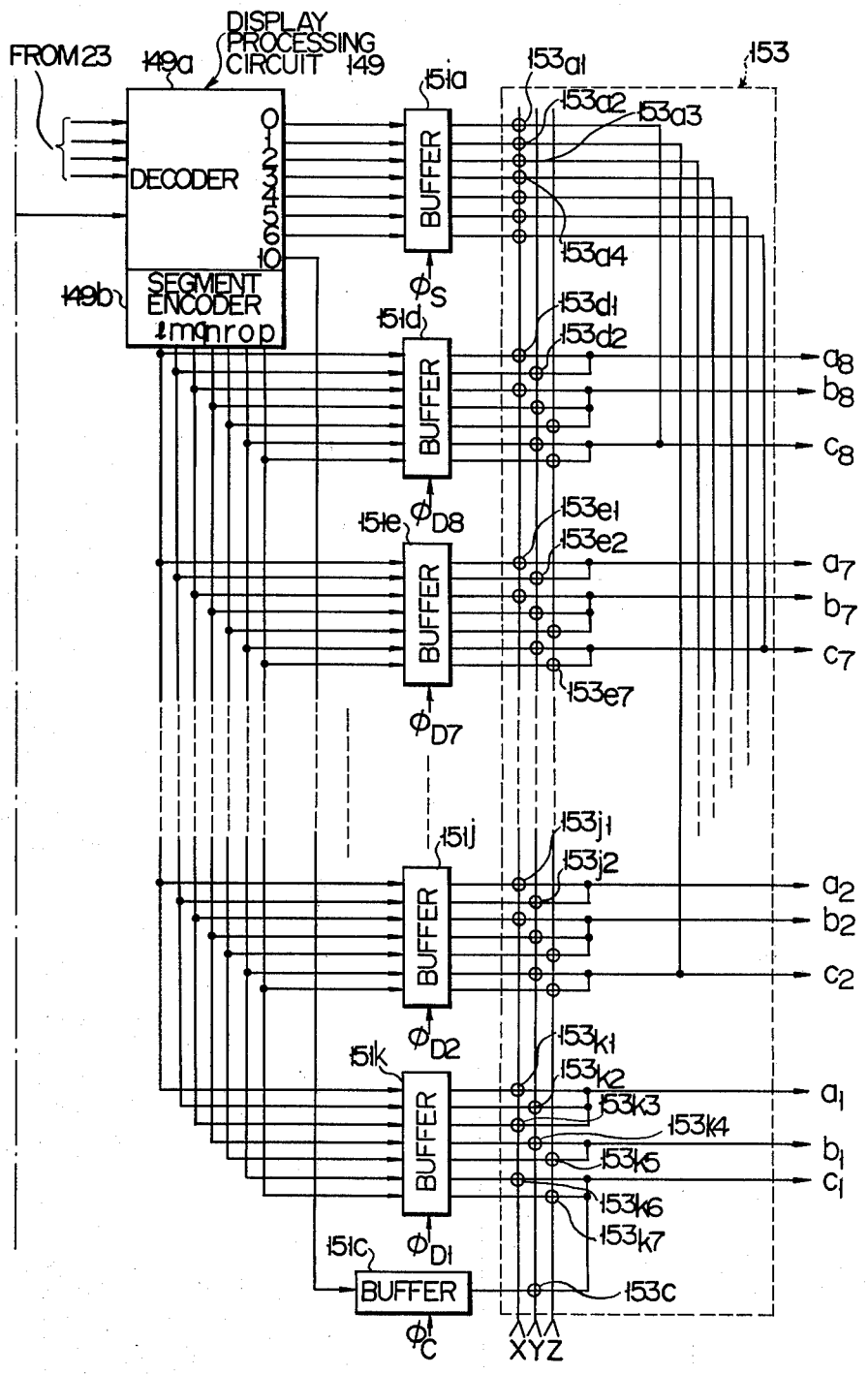

FIGS. 15(A) and 15(B) show the details of a display processing circuit 149, display buffers 151*a* to 151*k*, writein control circuit 152 and first electrode group drive signal generator. The write-in control circuit 152 includes a decoder 152*a* for decoding the address data fed from the address controller 144 and AND gates 152*b*$_1$ to 152*b*$_{11}$ which are coupled at one input terminals with the decoder lines and at the other input terminals with the timing signals outputted from the timing generator 146. The output of the AND gate 152*b*$_1$ is applied as a clock signal $\phi_S$ to the display buffer 151*a*. The output of the AND gate 152*b*$_2$ is applied as a write-in clock signal $\phi_{D8}$ to the display buffer 151*d*. Similarly, the outputs $\phi_{D1}$, $\phi_C$ of the AND gates 152*b*$_{10}$ and 152*b*$_{11}$ are applied to the display buffers 151*k* and 151*c*, respectively. In FIGS. 15(A) and 15(B), the display buffer 151*b* for storing the display position of the decimal point and the AND gate 152*b*$_2$ are omitted but the connection of them are similar to that of the above-mentioned ones. The outputs 0 to 6 of the decoder 149*a* of the display processing circuit 149 are the display buffer 151*a* comprising seven flip-flops (not shown) and the output 10 is applied to the display buffer 151*c* including a single flip-flop. The outputs of the segment encoder 149*b* are outputted in the order of m, n, l, r, o, q and p and coupled with the display buffers 151*a*, 151*d* to 151*k* each including seven flip-flops. The seven bits outputs of each of the buffers 151*a*, 151*d* to 151*k* and one bit output of the buffer 151*c* are coupled with first electrode group signal generator 153 where they are properly combined. The outputs corresponding to the segments m and n of the seven bits outputs of each display buffers 151*d* to 151*j* for storing the display data in second to eighth digits are outputted through transfer gates 153*j*$_1$, 153*j*$_2$ . . . 153*d*$_1$, 153*d*$_2$ to which the second electrode drive signals X and Y and the output signals are commonly coupled each display buffer 151*j* to 151*d* and outputted as $a_2$ . . . $a_8$. The outputs corresponding to the segments l, r and o are outputted through transfer gates 153*j*$_3$, 153*j*$_4$, 153*j*$_5$ . . . 153*d*$_3$, 153*d*$_4$, 153*d*$_5$ to which the second electrode drive signals X, Y and Z are applied, and the output signals are commonly coupled each display buffer 151*j* to 151*d* and outputted as $b_2$ to $b_8$. The outputs corresponding to the segments q and p are commonly coupled through transfer gates 153*j*$_6$, 153*j*$_7$ . . . 153*d*$_6$, 153*d*$_7$ to which the second electrode drive signals Y and Z are applied and outputted from the display buffers 151*j* to 151*d* as $c_2$ to $c_8$.

The outputs corresponding to the segments m and n of the display buffer 151*k* for storing the first digit display data are outputted through transfer gates 153*k*$_1$ and 153*k*$_2$ to which the second electrode drive signals X and Y are applied and the outputs are commonly coupled and outputted as a first electrode drive signal $a_1$. The outputs corresponding to the segments l, r and c are outputted through transfer gates 153*k*$_3$, 153*k*$_4$ and 153*k*$_5$ to which second electrode drive signals X, Y and Z are applied and the outputs are coupled commonly and outputted as a first electrode drive signal $b_1$. The outputs corresponding to the segments q and p are outputted through transfer gates 153*k*$_6$ and 153*k*$_7$ to which the second electrode drive signals X and Z are applied and the outputs are commonly coupled and outputted as a first electrode drive signal $c_1$.

The seven bits outputs of the display buffer 151*a* for storing the day of the week data are outputted through transfer gates 153*a*$_1$ to 153*a*$_7$ to which the second electrode drive signal X is applied. The output of the flip-flop connected to a data line "0" of the transfer gate 153*a*$_1$ is connected to the common output of the transfer gates 153*d*$_6$ and 153*d*$_7$, i.e. the line of the first electrode drive signal $c_8$. In a similar manner, the outputs of the transfer gates 153*a*$_2$ to 153*a*$_7$ are coupled with lines of the first electrode drive signals $c_2$ to $c_7$, respectively. The output of the display buffer 151*c* for storing the calendar data is connected via a transfer gate 153 to which the timing of the second electrode drive signal Y is applied, to the common output of the transfer gates 153*k*$_6$ and 153*k*$_7$, i.e. the first electrode drive signal $c_1$ line.

Figure 16:
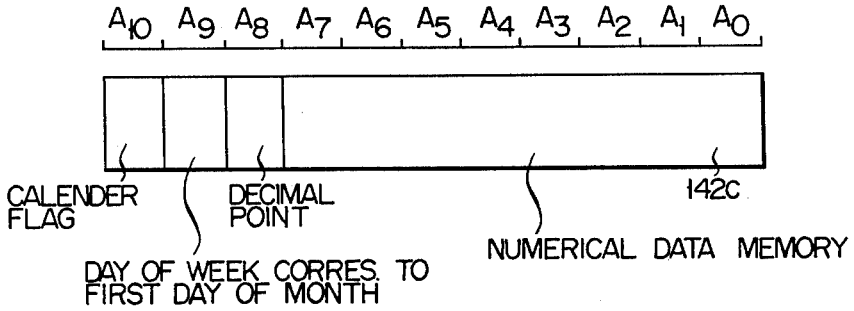
FIG. 16 schematically shows the contents of the register included in the RAM in FIG. 14.

FIG. 16 shows the register structure of an A register in the third area 142*c* of the RAM 142 shown in FIG. 14. As seen from the figure, the first to eighth digits ($A_0$ to $A_7$) stores numerical data. The 9th digit ($A_8$) stores decimal point. The 10th digit ($A_9$) stores the days of a week corresponding to the 1st day of a month in which "0 to 9" are assigned for the days of a week; for example, "0" is assigned for Sunday and "6" for Saturday. The 11th digit ($A_{10}$) stores a flag for calendar data.

Figure 17:
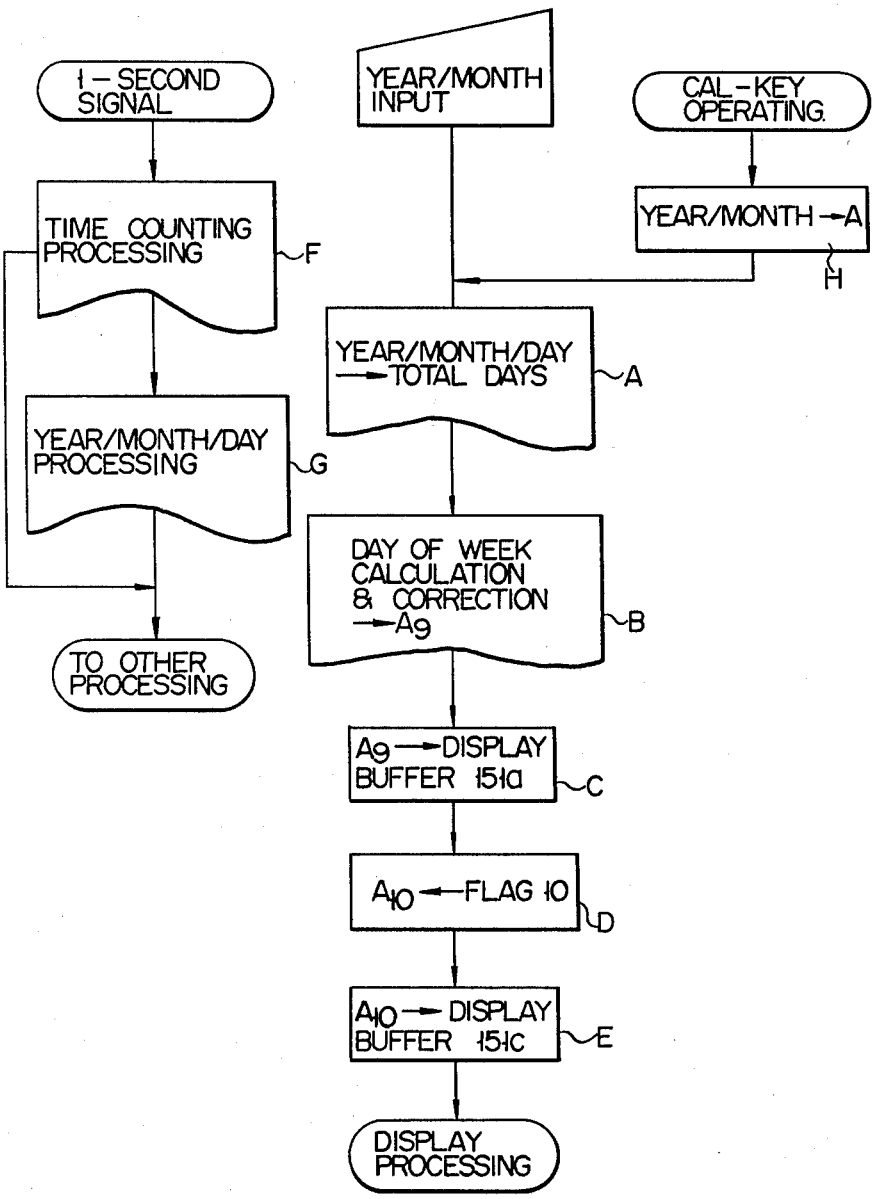
FIG. 17 shows flow charts useful in explaining the operation of the circuit in FIG. 14.

Let us consider the operation to make a display of "March in 1976" on the device with the above-mentioned construction. FIG. 17 is a flow chart for illustrating the operation of the calendar display. Proper keys on the key input unit 148 shown in FIG. 14 are first depressed to input "1976" of year and "3" of month. The inputted data are written into a given register of the second area 142*b* of the RAM 142. After completion of this input operation, the controller 142 advances to a process A to calculate "month, day, year→date". In preparation for this, the date "1" is added to "1976, 3" stored therein to obtain "1976, 3, 1". Then, the controller outputs a series of instructions for calculating the days from a virtual reference day (March 1, 0 A.D.) of the "1976, 3, 1". And the following calculation will be executed by using the respective registers in the second area 142*b* of the RAM 142.

If $b \geqq 3$ $$365.25 \times a + 30.6 \times (b-3) + c \quad (1)$$

If $b < 3$ $$365.25 \times (a-1) + 30.6 \times (b+9) + c \quad (2)$$

where a=Anno Domini, b=month, c=day.

The days from the virtual reference day of the "1976, 3, 1" is calculated by using the equation (1). The result of the calculation is "721735". This is loaded into a given register in the second area 142*b* of the RAM 142.

Then, a process B is executed. In the process B, the days calculated from the reference day is divided by "7" and the day of a week is calculated by using the remainder and correction is made of a departure of the day of the week due to the fact that the days calculated from the virtual reference day is "1". Firstly, the calculation to obtain the remainder when the "721735" is divided by "7", under control of a series of instructions given from the ROM 141*a* and through the second area 142*b* and the operation/decision unit 143. The result of it is Quotient . . . 103105

Remainder . . . 0

Figure 10:
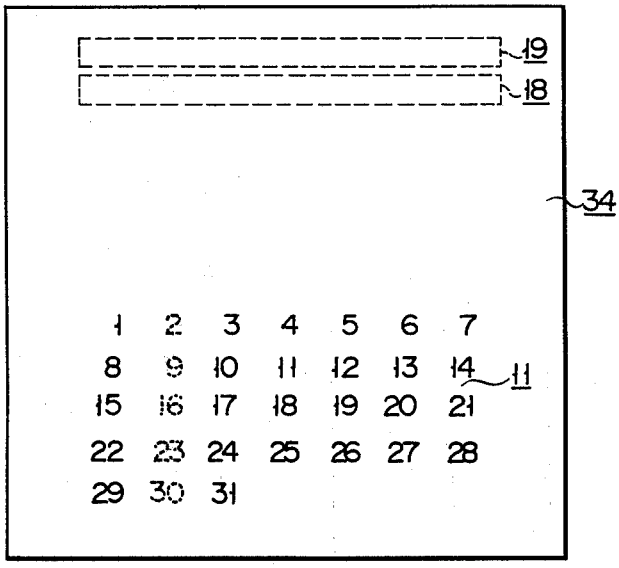
FIG. 10 is one form of the displays of the calendar display shown in FIGS. 9(A) and 9(B)
Figure 18:
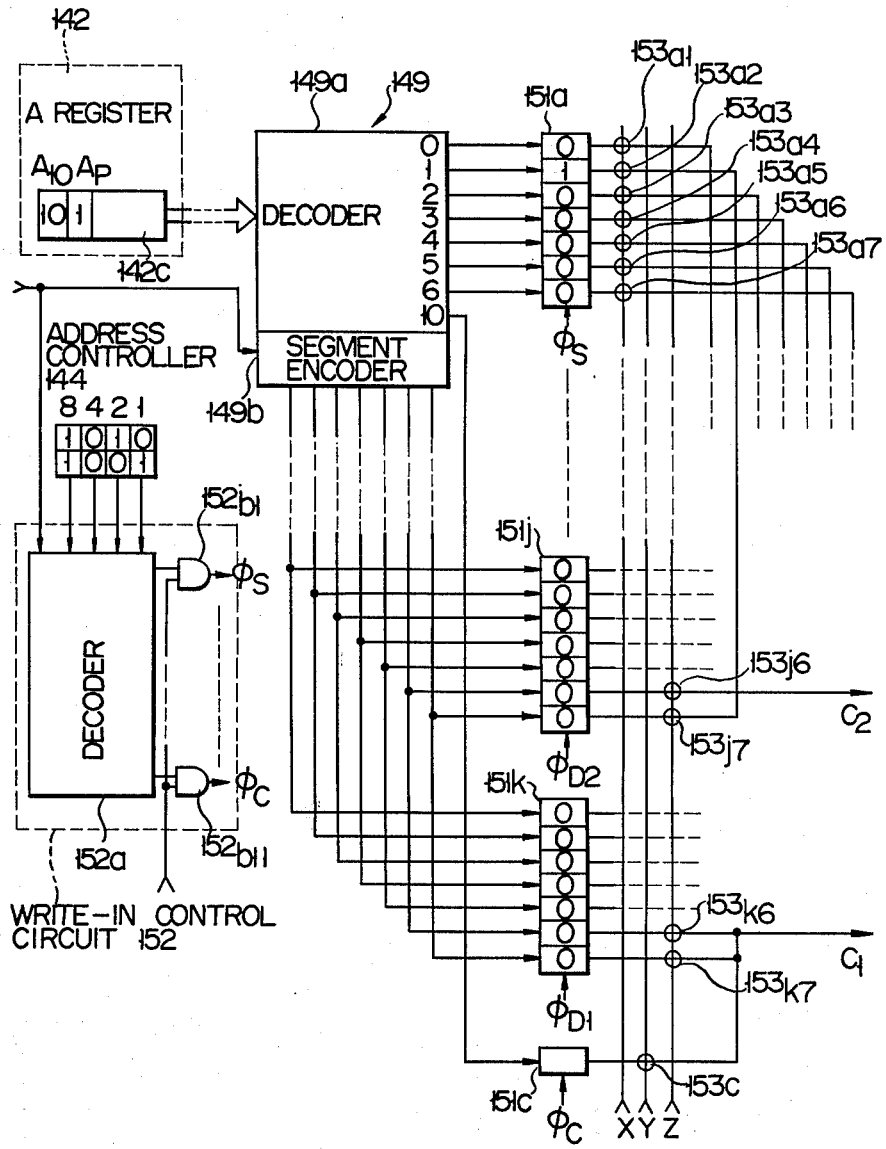
FIG. 18 shows a wiring diagram of the major part of FIGS. 15(A) and 15(B) for explaining the operation of the circuit of FIGS. 15(A) and 15(B)
Figure 19:
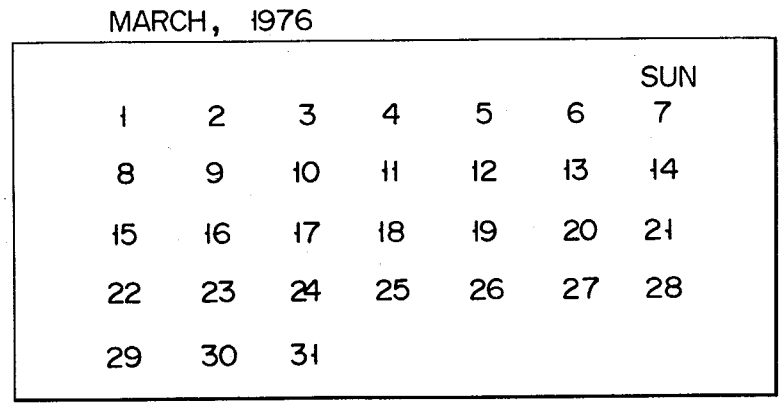
FIG. 19 shows the display surface in FIG. 14 when the calendar data is displayed on the display surface.

After obtaining of the remainder "0", the correction of the day of the week will be executed. The virtual reference day is assumed to be Sunday. When the days of the week, Sunday to Saturday, are expressed by "0" to 37 6", "1" is added to "0" of the remainder since the departure is "1". As a result, the data for the day of the week is "1" which in turn is loaded into the 10th digit ($A_9$) of the register A in the third area 142*c* of the RAM 142. Then, a process step C is executed. In this step, the contents of the $A_9$ is loaded into the display buffer 151*a* via the display processing circuit 199. The address controller 144 specifies the column address "9" and at the same time to select the control circuit 152 to which the "9" is loaded. At this time, the write-in control circuit 152 has received the display signal D from the instruction decoder 145. Accordingly, the decoder 152*a* decodes the column address "9" selected from the address controller 144 to enable the AND gate 152*b*$_1$ to produce the clock signal $\phi_S$ as shown in FIG. 10. The data "1" being stored in the $A_9$ which is fed to the display processing circuit 149 via the operation/decision section 143, is decoded by the decoder 149*a*. The decoded signal is applied to the display buffer 151*a*. Therefore, the display buffer 151*a* is controlled by the write-in clock outputted from the write-in control circuit 152 to have the contents "0100000" from above, as shown in FIG. 18. Then, the process advances a step D where a flag code "10" is loaded into the flag digit ($A_{10}$) of the A register for directing the calendar display. The process further advances a step E. The loading of the code "10" is conducted through an operation that the code "10" outputted from the ROM 141*a* is applied to the RAM 142 via the operation/decision section 143. In the step E, the flag code "10" loaded into the 11th digit ($A_{10}$) of the register A included in the third area 142*c* in the RAM 142 is set in the display buffer 151*c* via the display processing circuit 149. At this time, the address controller 144 outputs the flat code "10", and the decoder 152*a* of the write-in control circuit 152 enables the AND gate 152*b*$_{11}$ after decoding the code "10", thereby to produce the write-in clock signal $\phi_C$. The contents "10" of the digit $A_{10}$ read out from the third area 142*c* of the RAM 142 is applied to the display processing circuit 149 via the operation/decision section 143 where it is decoded by a decoder 149*a*. As a result of the decoding, the decoder produces outputs at the output lines corresponding to the code "10" which are then set in the display buffer 151*c* as shown in FIG. 18, with its contents of "1". Accordingly, when the data of month and year are inputted from the key input unit 148 in FIG. 14, it passes through processes A and B or the steps C to E. As a result, the data corresponding to the day of a week corresponding to the first day of the month is loaded into the display buffer 151*a* and the "1" representing the calendar data is loaded into the display buffer 151*c*. Then, the operation shifts to the display process where the calendar data is displayed. In this example, the display system is of dynamic drive type of ⅓ duty. Accordingly, the second electrode drive signals X, Y and Z are repeatedly produced so that a desired display is performed depending on the memory contents of the display buffers 151*a* to 151*k* at the respective timings. At present, the contents of the buffers 151*a* to 151*k* is as shown in FIG. 18. Accordingly, the "1" outputted through the transfer gate 153*a*$_2$ at the timing of the second electrode drive signal X is outputted as a first electrode drive signal $c_2$ which in turn is applied to the terminal $c_2$ of the display device 156 via the first electrode drive circuit 154. As a consequence, there is produced a given potential between the first electrode 500*a* and the second electrode 130*a* to indicate that the column of the date "7, 14, 21, 28" corresponds to Sunday, as seen from FIG. 13(B) and FIGS. 12(A) and 12(B). The "1" outputted through the transfer gate 153*c* at the timing of the outputting of the signal Y, is outputted as a first electrode drive signal $c_1$ which in turn is applied to the terminal $c_1$ of the display device 156 via the first electrode drive circuit 156. In the display device, there is produced a given potential difference between the electrodes 8*a* to 8*g* and the second electrodes 120*a* to 120*g* thereby to display the "1 to 31". The display obtained at this time is as shown in FIG. 19. In the above description, the week and day data are displayed at the timings of the outputting of the second electrode drive signals X, Y and Z. In fact, however, the display in the device 156 is carried out by the effective value during the output periods of the signals X, Y and Z. Also, in the above description, there is no combination at the timing of the second electrode drive signal Z and only the day of a week and day are displayed. However, when the data relating year and month are loaded into the display buffers 151*a* to 151*d*, such data may be displayed.

As described above, the example of the invention may automatically calculate the day corresponding to Sunday depending on the "year" and "month" and display a calendar as a usual one.

Additionally, a calendar may automatically be displayed by using the time counting function performed by using the first area 142*a*. As shown in FIG. 14, the one-second interval signal (one-second signal) from the frequency divider 147*a* for frequency dividing the output of the oscillator 146*a*, is outputted and the output is set in the latch circuit 147*b*. The output of the latch circuit 147*b* is applied as an address modifier signal to the address section 141*b* of the controller 141. On this application, the process F shown in FIG. 17 starts. In the step, the operation/decision section 143 performs a "+1" operation to the area storing the time counting data in the first area 142*a* of the RAM 142, and carry operation such as scale-of-60, scale-of-12, scale-of-24, etc. is carried out. Through this processing, if there is no change of day (passing 24 hours), it directly advances other processes such as arithmetic operation or display, and then a process G. In the process G, when the change of day is detected, one day is added to the area storing the calendar data in the first area 142*a* of the RAM 142 and it is judged as to the "30 days month", "31 days month", "FEB (common year)" or "FEB (leap year)".

Thus, an operator depresses the calendar display key "CAL" on the input unit 148 with an interior to know the calendar of this month. In this case, the step H reads out from the calendar data storing area in the first area 142*a* of the RAM 142 only the data of "year" and "month", and then sets the data in the A register in the 3rd year 142*c*. Then, the above mentioned process and steps A to E are executed to display the calendar of the month, as in the "March, 1976" case.

It will be seen from the foregoing that the calendar of the month may be automatically be displayed by incorporating the example of the invention into the time counting device.

Figure 20:
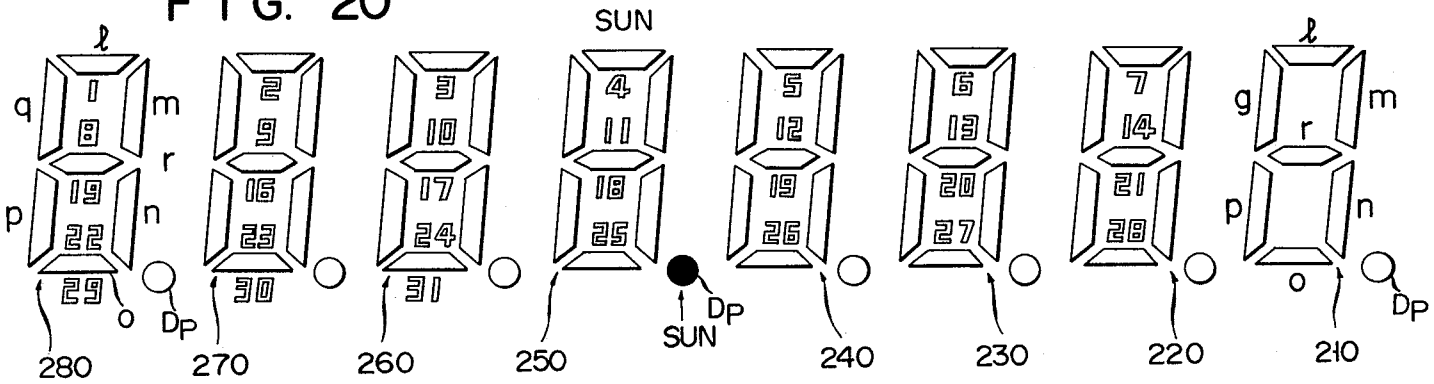
FIG. 20 illustrates an arrangement of display segments and character electrodes on the display surface of the display device which is another embodiment of the invention.
Figure 21:
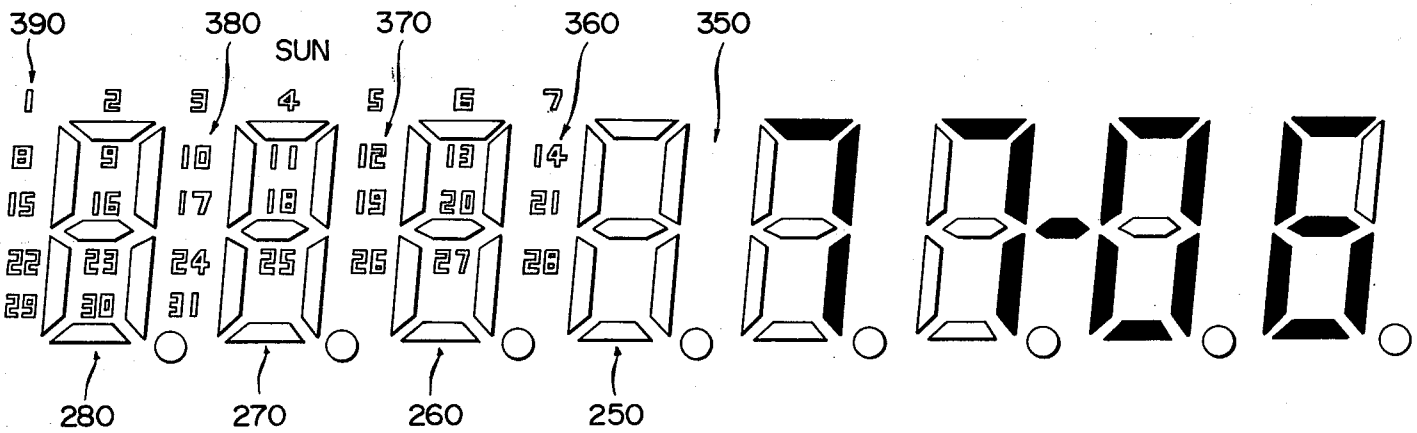
FIG. 21 illustrates an arrangement of display segments and character electrodes on the display surface of the display device which is still another embodiment of the invention.

In the above example, the numeral electrodes 8*a* to 8*g* are partly disposed in the spaces between adjacent display members 210 to 280. However, an arrangement of numeral electrodes 8*a* to 8*g* for calendar display as shown in FIG. 20 is possible. In the figure, two numeral electrodes are vertically disposed one above another in each space defined by four segments and a single numeral electrode is disposed under the bottom of each of the display members 260 to 280. Alternately, a display shown in FIG. 21 is also permitted. In this example, the numeral electrodes 8*a* to 8*g* are disposed in the digit in-between spaces 390 to 360 and the spaces formed in the display members 260 to 280.

When it is desired to obtain the calendar of the preceding or succeeding month, it is obtainable merely by changing the data in the month now used. Such is easily realized through the key operation of a given key on the key input unit.

As described above, when the invention is applied to the desk top electronic calculator with time counting function, there is no need for any special circuit for the calendar display and a remarkable enlargement of the display surface.

The display device of the invention may be applied for desk top electronic calculators without a time counting function and usual digital electronic clocks and the like, in addition to electronic calculators with a time counting function.

In the above-described examples, the numeral electrodes for calendar display are disposed on the higher digit side of the display members for time display; however, the disposition thereof is not limited to such position. Essentially, it is necessary that at least a part of the calendar display members is disposed in the digit in-between spaces of the time display members.

"SUN" representing the day of a week disposed above the calendar display members may be replaced by decimal point, for example.

What is claimed is:

1. An electronic display device comprising:

a digital display portion having a plurality of segmental display members which are arranged such that each segmental display member digitally displays a numeral by using segments, the segments of said segmental display members being arranged to define a plurality of spaces between segments; and a calendar display portion having numeral display members 1 to 31 for displaying dates of one month arranged in plural rows and plural columns, at least some of said numeral display members being disposed in the spaces defined by the segments of said digital display portion.

2. An electronic display device according to claim 1, in which said numeral display members for date display are arranged in fourteen columns.

3. An electronic display device according to claim 1, in which said display device is a part of an electronic wrist watch.

4. An electronic display device according to claim 1, in which said display device is part of an electronic calculator.

5. An electronic display device according to claim 1, in which said numeral display members for date display are arranged in seven columns.

6. An electronic display device according to claim 1, in which said numeral display members for date display are disposed in the spaces between adjacent digits of said segmental display members.

7. An electronic display device according to claim 1, in which said numeral display members for date display are disposed in the spaces between adjacent digits of said segmental display members and in the spaces in said segmental display members.

8. An electronic display device according to claim 1, in which said calendar display portion has numerals 1 to 31 for one month dates arranged in five rows and seven columns.

9. An electronic display device according to claim 1, in which said calendar display portion further includes indicators, each indicator indicating the column corresponding to a specified day of a week.

10. An electronic display device according to claim 1, comprising a single input terminal to which said numeral display members for date display are all commonly connected.

11. An electronic display device according to claim 1, in which said numeral display members for date display are commonly connected in each column.

12. An electronic display device according to claim 1, in which said numeral display members for date display are provided with corresponding input terminals, respectively.

13. An electronic display device according to claim 1, comprising an input terminal to which the numerals 1 to 28 of said numeral display members for date display are commonly connected; and wherein the numerals 29, 30 and 31 have corresponding input terminals, respectively.

14. An electronic display device according to claim 1, in which said numeral display members for date display are disposed in the spaces in said segmental display members.

15. An electronic display device according to claim 14, in which a plurality of said numeral display members for date display are disposed in a single space in said segmental display member.

16. An electronic display device according to claim 1, in which said calendar display portion has numerals 1 to 31 for one month dates arranged in three rows and fourteen columns.

17. An electronic display device according to claim 16, further comprising:

control means to obtain at least time data including at least "hours" and "minutes" as a function of a reference clock signal and the date for indicating the column corresponding to a specified day of a week in said calendar display portion (at this time, said calendar display portion is not actuated);

means for displaying the time data from said control means in said digital display portion in a normal state;

operation instruction means for providing a display instruction to said calendar display portion; and display control means coupled to said operation instruction means and to said control means for actuating said calendar display portion in response to a display instruction from said operation instruction means, for indicating the column corresponding to the specified day of a week in response to the data of the specified day of the week column fed from said control means and for digitally displaying the "month" information from said control means by means of said segmental display members in said digital display portion.

18. An electronic display device according to claim 17, further comprising means for digitally displaying the date data from said control means in response to a display instruction from said operation instruction means.

19. An electronic display device according to claim 1, further comprising:

control means to obtain at least time data including at least "hour" and "minutes" as a function of a reference clock signal and the data for indicating the column corresponding to a specified day of a week in said calendar display portion;

means for displaying the time data from said control means in said digital display portion in a normal state;

operation instruction means for providing a display instruction to said calendar display portion; and display control means coupled to said operation instruction means and to said control means for actuating said calendar display portion in response to a display instruction from said operation instruction means and for indicating the column corresponding to the specified day of a week in response to the data of the specified day of the week column fed from said control means.

20. An electronic display device according to claim 19, comprising a single input terminal to which said numeral display members for date display of 1 to 31 are all commonly connected.

21. An electronic display device according to claim 19, comprising an input terminal to which the numerals 1 to 28 of said numeral display members for date display are commonly connected; and wherein the numerals 29, 30 and 31 have corresponding input terminals, respectively.

22. An electronic display device according to claim 19, in which said numeral display members for date display in said calendar display portion are commonly connected in each column.

23. An electronic display device according to claim 19, in which numerals 29, 30 and 31 of said numeral display members have corresponding input terminals, respectively, and the numerals 1 to 28 are commonly connected in each column and coupled to a single input terminal.

24. An electronic display device according to claim 19, in which said calendar display portion includes a plurality of indicators, each associated with a respective one of said columns; and said display control means includes means for actuating at least one of said indicators for indicating the column corresponding to the specified day of a week in said calendar display portion.

25. An electronic display device according to claim 19, in which said display control means includes means for providing a flash instruction signal for flashing said numeral display members for date display belonging to the column of the specified day of a week.

26. An electronic display device according to claim 19, in which said numeral display members for date display are commonly in each column to corresponding input terminals, respectively, and means is provided to provide a flash control signal to said input terminals for flashing the numerals in the column containing the specified day of a week in response to a display instruction signal from said display control means.

27. An electronic display device according to claim 23 or 25, in which said control means includes means for obtaining the "month" data; and means responsive to said "month" data for supplying a display instruction control signal to the input terminals of the numerals 29, 30 and 31 as a function of said "month" data.

28. An electronic display device according to claim 1, further comprising:

control means to obtain at least time data including at least "hour" and "minutes" as a function of a reference clock signal and the data for indicating the column corresponding to a specified day of a week in said calendar display portion;

means for constantly supplying said time data from said control means to said segmental display members and for constantly actuating said calendar display portion; and display control means coupled to said control means for indicating the specified day of a week column in said calendar display portion in response to the data indicating the specified day of the week column from said control means.

29. An electronic display device according to claim 28, in which said control means includes means for obtaining the "month" data; said numeral display members for date display of at least 29, 30 and 31 have individual input terminals, respectively; and further comprising means coupled to said control means for applying a display instruction signal which is a function of said "month" data to selected ones of said input terminals of said 29, 30 and 31 numeral display members of said date display.

30. An electronic display device according to claim 1, in which the display device is a liquid crystal display device.

* * * * *

UNITED STATES PATENT AND TRADEMARK OFFICE

CERTIFICATE OF CORRECTION

PATENT NO. : 4,205,516

DATED : June 3, 1980

INVENTOR(S) : Hiroyuki TERAO

It is certified that error appears in the above-identified patent and that said Letters Patent are hereby corrected as shown below:

Column 19, lines 41-42, change "position" to --positions--;

Column 22, line 13 (claim 26), replace "commonly in each" with --commonly connected in each--.

Signed and Sealed this

*Twenty-eighth* Day of *October 1980*

[SEAL]

*Attest:*

SIDNEY A. DIAMOND

*Commissioner of Patents and Trademarks*

*Attesting Officer*